US012571387B2

(12) United States Patent
Ogawa et al.

(10) Patent No.: US 12,571,387 B2
(45) Date of Patent: Mar. 10, 2026

(54) PUMP CAVITATION DETECTION DEVICE, METHOD, AND SYSTEM

(71) Applicant: Yokogawa Electric Corporation, Tokyo (JP)

(72) Inventors: Hiromitsu Ogawa, Tokyo (JP); Soichiro Konada, Tokyo (JP)

(73) Assignee: Yokogawa Electric Corporation, Tokyo (JP)

( * ) Notice: Subject to any disclaimer, the term of this patent is extended or adjusted under 35 U.S.C. 154(b) by 230 days.

(21) Appl. No.: 18/229,892

(22) Filed: Aug. 3, 2023

(65) Prior Publication Data

US 2024/0044327 A1 Feb. 8, 2024

(30) Foreign Application Priority Data

Aug. 5, 2022 (JP) ..... 2022-125733

(51) Int. Cl.
*F04B 51/00* (2006.01)
*F04B 49/06* (2006.01)

(52) U.S. Cl.
CPC ..... *F04B 51/00* (2013.01); *F04B 49/065* (2013.01); *F04B 2205/07* (2013.01); *F04B 2205/503* (2013.01)

(58) Field of Classification Search
CPC . G01L 19/147; G01L 9/0072; G01L 19/0645; G01L 19/0084; G01L 13/025;
(Continued)

(56) References Cited

U.S. PATENT DOCUMENTS 5,235,524 A * 8/1993 Barkhoudarian ..... F04D 29/669 702/39
6,260,004 B1 7/2001 Hays et al.
(Continued)

FOREIGN PATENT DOCUMENTS

CA 2977998 A1 * 3/2018 ..... F04B 51/00
DE 3725754 A1 * 2/1989 ..... F04D 15/0088
(Continued)

OTHER PUBLICATIONS

Extended European Search Report (EESR) dated Dec. 8, 2023 issued in European patent application No. 23188881.9.
(Continued)

*Primary Examiner* — Andre J Allen
(74) *Attorney, Agent, or Firm* — RANKIN, HILL & CLARK LLP

(57) ABSTRACT

A suction pressure acquisition unit acquires pressure data indicating pressure of a pump. A variation coefficient calculation unit calculates a variation coefficient indicating amplitude of pressure magnitude of the pump on a basis of the pressure data acquired by the suction pressure acquisition unit. An adjustment unit performs adjustment detection information that includes the variation coefficient calculated by the variation coefficient calculation unit, by using a pressure transmission coefficient representing ease of transmission for pressure of the pump. The detection information is used for cavitation occurrence detection. A determination unit 125 detects cavitation occurrence in the pump on a basis of the detection information adjusted by the adjustment unit.

16 Claims, 10 Drawing Sheets

(58) Field of Classification Search

CPC ..... G01L 19/0007; G01L 9/0042; G01L 19/0038; G01L 9/0073; G01L 9/0075; G01L 9/0054; G01L 9/0055; G01L 19/04; G01L 7/00; G01L 7/04; G01L 19/148; G01L 19/14; G01L 19/143; G01L 17/00; G01L 7/18; G01L 19/0092; G01L 15/00; G01L 9/0051; G01L 7/041; G01L 9/12; G01L 9/065; G01L 19/0618; G01L 9/0052; G01L 9/125; G01L 7/16; G01L 19/0609; G01L 19/003; G01L 9/007; G01L 19/0627; G01L 19/0046; G01L 9/0022; G01L 9/06; G01L 19/0636; G01L 7/084; G01L 13/02; G01L 19/0023; G01L 19/142; G01L 7/043; G01L 19/08; G01L 9/0002; G01L 19/02; G01L 9/008; G01L 19/141; G01L 9/006; G01L 11/02; G01L 19/0672; G01L 23/10; G01L 23/18; G01L 19/0681; G01L 9/0077; G01L 19/12; G01L 27/005; G01L 7/082; G01L 9/0044; G01L 19/0015; G01L 19/0069; G01L 7/063; G01L 9/0001; G01L 19/146; G01L 21/12; G01L 27/002; G01L 27/007; G01L 9/16; G01L 11/00; G01L 19/00; G01L 9/0026; G01L 9/0089; G01L 9/045; G01L 9/14; G01L 19/0654; G01L 1/2281; G01L 11/025; G01L 13/026; G01L 11/008; G01L 7/22; G01L 9/0047; G01L 7/08; G01L 9/0076; G01L 9/0025; G01L 9/0035; G01L 19/0061; G01L 9/0005; G01L 9/0041; G01L 9/0019; G01L 9/08; G01L 9/10; G01L 21/00; G01L 9/04; G01L 11/006; G01L 19/086; G01L 9/00; G01L 9/00; G01L 1/18; G01L 11/004; G01L 19/069; G01L 9/0057; G01L 19/083; G01L 19/06; G01L 19/10; G01L 19/16; G01L 9/0016; G01L 13/023; G01L 7/048; G01L 9/0048; G01L 9/0027; G01L 9/0086; G01L 9/0079; G01L 11/04; G01L 1/20; G01L 9/0091; G01L 27/00; G01L 11/002; G01L 23/24; G01L 7/182; G01L 1/02; G01L 19/0663; G01L 7/166; G01L 23/22; G01L 9/0036; G01L 9/0061; G01L 9/0039; G01L 23/125; G01L 19/145; G01L 9/0013; G01L 21/04; G01L 9/0045; G01L 9/0092; G01L 1/142; G01L 7/104; G01L 9/0033; G01L 9/0083; G01L 9/0098; G01L 1/2293; G01L 7/24; G01L 9/02; G01L 21/22; G01L 9/0029; G01L 7/022; G01L 1/205; G01L 9/0064; G01L 23/08; G01L 5/14; G01L 13/06; G01L 23/16; G01L 7/088; G01L 7/163; G01L 9/0007; G01L 23/222; G01L 1/16; G01L 1/2287; G01L 9/0085; G01L 9/025; G01L 1/2212; G01L 21/14; G01L 9/0004; G01L 23/02; G01L 9/003; G01L 9/085; G01L 1/14; G01L 1/148; G01L 9/0058; G01L 9/105; G01L 7/02; G01L 7/061; G01L 9/002; G01L 1/2231; G01L 13/028; G01L 9/0095; G01L 23/28; G01L 1/162; G01L 19/0076; G01L 7/12; G01L 9/0038; G01L 9/0032; G01L 21/10; G01L 7/024; G01L 19/149; G01L 1/246; G01L 7/086; G01L 1/005; G01L 5/228; G01L 7/06; G01L 1/2206; G01L 7/102; G01L 13/021; G01L 27/02; G01L 1/2262; G01L 1/24; G01L 1/26; G01L 9/0094; G01L 19/144; G01L 9/0082; G01L 1/125; G01L 9/0097; G01L 1/2268; G01L 11/06; G01L 21/30; G01L 21/34; G01L 23/221; G01L 7/187; G01L 7/20; G01L 1/146; G01L 23/26; G01L 7/068; G01L 1/144; G01L 1/225; G01L 23/32; G01L 7/14; G01L 1/165; G01L 23/12; G01L 1/241; G01L 13/04; G01L 7/045; G01L 1/086; G01L 1/22; G01L 7/108; G01L 9/18; G01L 17/005; G01L 5/18; G01L 1/245; G01L 21/32; G01L 1/183; G01L 1/2218; G01L 9/0023; G01L 1/243; G01L 23/145; G01L 5/0047; G01L 5/0076; G01L 9/0088; G01L 1/106; G01L 1/10; G01L 9/001; G01L 1/186; G01L 23/223; G01L 25/00; G01L 5/165; G01L 5/226; G01L 9/0017; G01L 1/044; G01L 3/245; G01L 9/005; G01L 1/08; G01L 21/16; G01L 3/1485; G01L 5/0038; G01L 5/162; G01L 5/225; G01L 7/026; G01L 7/065; G01L 9/0014; G01L 1/04; G01L 1/242; G01L 21/24; G01L 3/10; G01L 5/0004; G01L 5/0052; G01L 5/24; G01L 7/10; G01L 1/00; G01L 1/103; G01L 1/2275; G01L 1/247; G01L 21/02; G01L 21/26; G01L 23/225; G01L 3/102; G01L 3/105; G01L 5/223; G01L 7/028; G01L 9/0011; G01L 5/00; G01L 5/0028; G01L 5/243; G01L 1/083; G01L 1/12; G01L 21/36; G01L 23/14; G01L 23/30; G01L 3/103; G01L 5/0033; G01L 5/102; G01L 5/133; G01L 5/1627; G01L 5/166; G01L 7/185; G01L 1/255; G01L 21/08; G01L 5/0057; G01L 5/22; G01L 1/042; G01L 1/122; G01L 1/2225; G01L 1/2243; G01L 1/2256; G01L 1/248; G01L 2009/0067; G01L 2009/0069; G01L 21/06; G01L 3/00; G01L 3/06; G01L 3/1478; G01L 3/1492; G01L 3/18; G01L 3/24; G01L 3/242; G01L 5/0061; G01L 5/08; G01L 5/10; G01L 5/101; G01L 5/108; G01L 5/16; G01L 5/161; G01L 5/167; G01L 5/28; G01L 1/046; G01L 2009/0066; G01L 2019/0053; G01L 23/085; G01L 23/20; G01L 5/0071; G01L 5/008; G01L 5/06; G01L 5/171; G01L 7/106; G01L 51/00; G01L 49/065; G01L 2205/05; G01L 2205/09; G01L 49/10; G01L 2201/0201; G01L 2201/0802; G01L 2205/11; G01L 49/06; G01L 2201/1201; G01L 2203/0208; G01L 2203/0209; G01L 17/03; G01L 53/10; G01L 13/00; G01L 2205/06; G01L 47/00; G01L 49/08; G01L 43/06; G01L 49/106; G01L 2201/0202; G01L 2201/1202; G01L 2201/1208; G01L 2203/0213; G01L 2205/01; G01L 2205/03; G01L 2205/13; G01L 23/021; G01L 35/045; G01L 39/0027; G01L 43/0081; G01L 43/02; G01L 43/046; G01L 49/103; G01L 15/02; G01L 19/22; G01L 2201/0601; G01L 2207/043; G01L 2207/702; G01L 37/14; G01L 47/028; G01L 49/20; G01L 53/16; G01L 1/0404; G01L 1/2064; G01L

17/003; G01L 2201/0205; G01L 2201/0207; G01L 2201/0208; G01L 2201/0209; G01L 2201/06012; G01L 2201/0605; G01L 2201/08; G01L 2201/0804; G01L 2201/1203; G01L 2201/1204; G01L 2201/1211; G01L 2203/0201; G01L 2203/0211; G01L 2203/0901; G01L 2203/0902; G01L 2203/0903; G01L 2203/091; G01L 2205/04; G01L 2205/061; G01L 2205/062; G01L 2205/08; G01L 2205/10; G01L 2205/16; G01L 2207/03; G01L 2207/041; G01L 2207/042; G01L 2207/044; G01L 23/106; G01L 39/00; G01L 39/0022; G01L 39/0238; G01L 39/08; G01L 39/1066; G01L 39/1073; G01L 39/122; G01L 39/125; G01L 41/00; G01L 43/0072; G01L 43/009; G01L 43/067; G01L 43/0736; G01L 43/082; G01L 43/1253; G01L 47/02; G01L 47/026; G01L 49/02; G01L 49/025; G01L 49/22; G01L 49/225; G01L 53/00; G01L 53/1082; G01L 53/14; G01L 53/144; G01L 7/0076; G01L 1/127; G01L 2201/0403; G01L 2201/0405; G01L 2203/0205; G01L 2203/0207; G01L 2205/14; G01L 2205/503; G01L 2207/70; G01L 2207/701; G01L 23/00; G01L 23/04; G01L 23/06; G01L 33/005; G01L 5/01; G01L 5/04; G01L 39/0292; G01L 39/10; G01L 39/12; G01L 39/121; G01L 43/073; G01L 49/04; G01L 5/02; G01L 7/0046

USPC ..... 73/168, 700–756

See application file for complete search history.

(56) References Cited

U.S. PATENT DOCUMENTS

| | | | | |
|---|---|---|---|---|
| 10,927,831 | B2 * | 2/2021 | Beisel | F04B 47/02 |
| 11,415,124 | B2 * | 8/2022 | Ogawa | G01M 13/00 |
| 11,994,150 | B2 * | 5/2024 | Ejjabraoui | F04D 1/00 |
| 2012/0204627 | A1 | 8/2012 | Anderl et al. | |
| 2020/0182239 | A1 | 6/2020 | Ogawa et al. | |
| 2021/0116321 | A1 * | 4/2021 | Olenik | G01L 19/12 |

FOREIGN PATENT DOCUMENTS

| | | | | | |
|---|---|---|---|---|---|
| EP | 0742372 | B1 | | 10/2001 | |
| GB | 2200991 | B | * | 1/1991 | G01N 29/228 |
| JP | 2020-90945 | A | | 6/2020 | |

OTHER PUBLICATIONS

European Office Action dated Dec. 16, 2025 and issued for European patent application No. 23188881.9.

* cited by examiner

PUMP CAVITATION DETECTION DEVICE, METHOD, AND SYSTEM

CROSS-REFERENCE TO RELATED APPLICATION

The present application claims priority to and incorporates by reference the entire contents of Japanese Patent Application No. 2022-125733 filed in Japan on Aug. 5, 2022.

FIELD

The present invention relates to a detection device, a detection method, and a detection system.

BACKGROUND

In various plants that perform production related to petroleum, petrochemicals, chemicals, gases, etc., pumps are used to transfer or pressure-feed liquids. Centrifugal pumps utilizing an impeller have been widely used as such pumps. However, in recent years, positive displacement pumps have been increasing used for the purpose of achieving high pressure and improving the accuracy of discharge rate.

Since the pump pressurizes a liquid taken in from the suction port and discharges the liquid from the discharge port, the liquid may evaporate inside and cause cavitation, depending on the operational state. The cavitation is a physical phenomenon in which gas bubbles or cavities appear and disappear in a short period of time due to pressure differences within a liquid. When cavitation occurs, it brings about a decrease in pump efficiency, generation of noise and vibration, and/or damage inside the pump. Further, the energy released when gas bubbles and/or cavities disappear can damage and destroy the pump, which could pose a significant safety risk. However, since it is difficult to completely prevent the occurrence of cavitation, it is important to have a mechanism that can detect cavitation occurrence at an early stage.

In consideration of the above, conventionally, a cavitation detection device has been proposed, as follows. For example, the detection device obtains the suction pressure of a pump from a pressure sensor, and obtains a variation coefficient, such as a standard deviation or moving average value, from the value of the suction pressure. Then, with reference to the variation coefficient in a state where the pump is operating normally, the detection device determines that cavitation has occurred when the current variation coefficient reaches several times the reference mentioned above. After that, the detection device displays the result on the administrator terminal or the like (Japanese Laid-open Patent Publication No. 2020-90945).

This technology evaluates the amount of pressure variation derived from cavitation on the basis of the variation coefficient, and performs cavitation detection. More specifically, when cavitation occurs in the pump, the pressure variation increases due to the cavitation as compared to when the pump is operating normally. Thus, on the basis of the variation coefficient, the detection device evaluates the magnitude of the pressure variation caused when cavitation occurs, to detect the cavitation occurrence. Therefore, this technology requires that the pressure variation is accurately transmitted to the pressure sensor.

However, in the conventional detection device, the cavitation occurrence detection may become unstable under the condition that the pressure variation is not accurately transmitted to the sensor. For example, as a case where the pressure variation is not accurately transmitted to the sensor, there is a case where the pressure is remarkably low globally or locally in the pump. Specifically, depending on the type of pump, the gas bubbles or cavities do not disappear because of the pressure decrease, so that cavities or the like are present inside the liquid and hinder the transmission of vibration. Consequently, there is a possibility that pressure variation can be hardly transmitted to the sensor accurately.

It is an object of the technology disclosed here to provide a detection device, a detection method, and a detection system that improve the accuracy of cavitation occurrence detection.

Solution to Problem

SUMMARY

It is an object of the present invention to at least partially solve the problems in the conventional technology.

According to an aspect of an embodiment, a detection device includes, a pressure acquisition unit that acquires pressure data indicating pressure of a pump, a variation coefficient calculation unit that calculates a variation coefficient indicating amplitude of pressure magnitude of the pump based on the pressure data acquired by the pressure acquisition unit, an adjustment unit that performs adjustment detection information which includes the variation coefficient calculated by the variation coefficient calculation unit, by using a pressure transmission coefficient representing ease of transmission for pressure of the pump, the detection information being used for cavitation occurrence detection; and a determination unit that detects cavitation occurrence in the pump based on the detection information adjusted by the adjustment unit.

The above and other objects, features, advantages and technical and industrial significance of this invention will be better understood by reading the following detailed description of presently preferred embodiments of the invention, when considered in connection with the accompanying drawings.

DESCRIPTION OF THE EMBODIMENTS

Embodiments of a detection device, a detection method, and a detection system disclosed in this application will be explained below in detail with reference to the accompanying drawings. The present invention is not limited to the following embodiments. Here, the corresponding constituent elements are denoted by the same reference symbols, and their repetitive description will be omitted as appropriate. Further, the disclosed embodiments may be combined as appropriate to an extent within the consistent range.

First Embodiment

Overall Configuration

Figure 1:
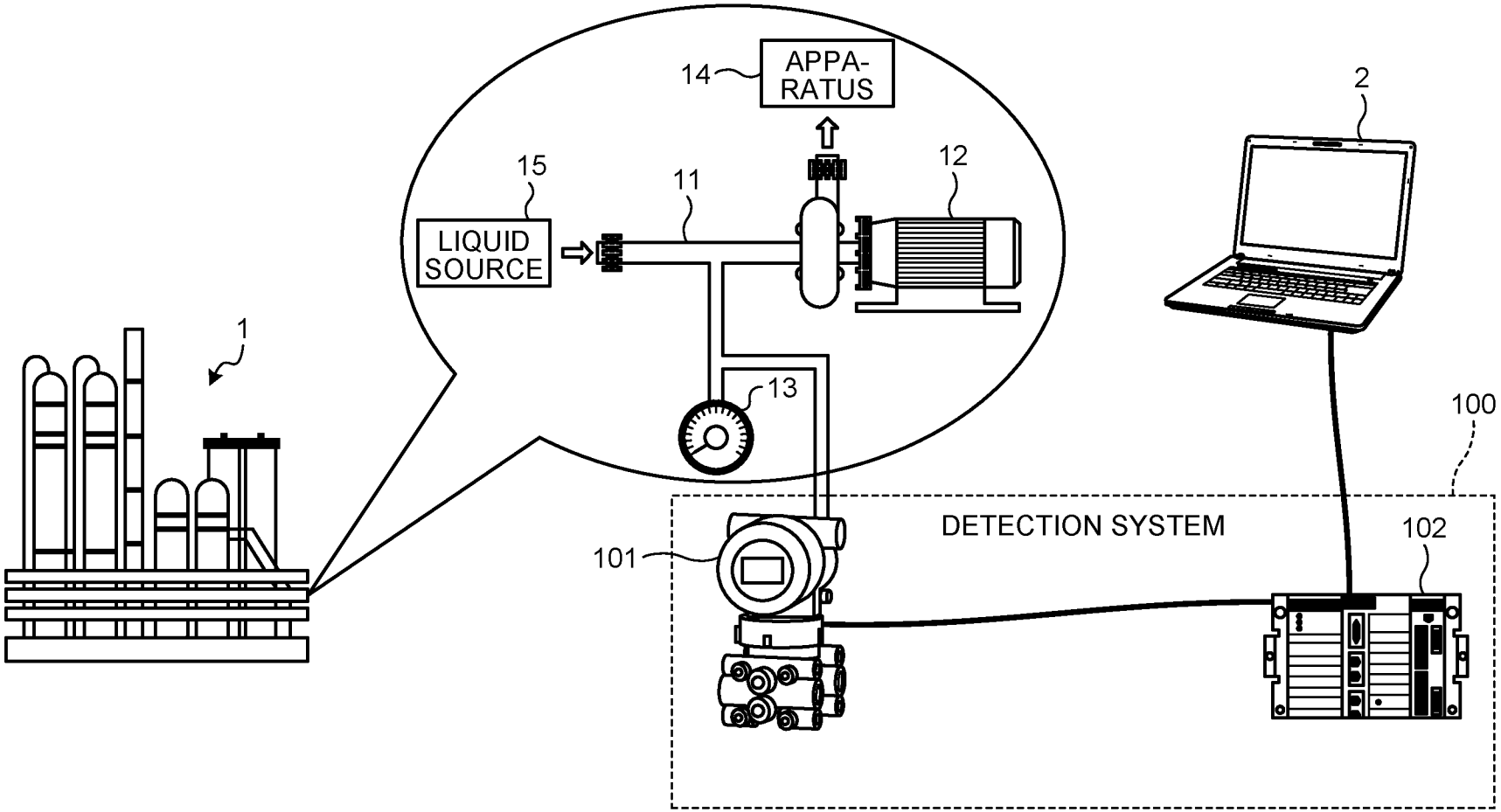
FIG. 1 is a diagram illustrating an example of the overall configuration of a plant in which a detection system is used.

FIG. 1 is a diagram illustrating an example of the overall configuration of a plant in which a detection system is used. With reference to FIG. 1, a brief explanation will be given of the configuration of the plant 1 in which a detection system 100 is used. As illustrated in FIG. 1, the plant 1, a management terminal device 2, and the detection system 100 are arranged.

The plant 1 is an example of various plants that perform production related to petroleum, petrochemicals, chemicals, gases, etc., and includes factories or the like provided with various facilities for obtaining products. Examples of the products are liquefied natural gas (LNG), resins (plastic, nylon, etc.), chemical products, etc. Examples of facilities are factory facilities, machinery facilities, production facilities, power generation facilities, storage facilities, facilities at wells where petroleum, natural gas, or the like is mined, etc.

The control system in the plant 1 is constructed with a distributed control system (DCS) or the like. For example, although not illustrated, by using the process data utilized in the plant 1, the control system in the plant 1 executes various types of control over the control apparatuses, such as field apparatuses and so forth, installed in the equipment to be controlled, and over operation apparatuses and so forth corresponding to the equipment to be controlled. The control system includes a computer, such as a server or the like. The detection system 100 and the management terminal device 2 may be included in the control system.

The plant 1 includes a pipe 11 and a pump 12 for transferring or pressure-feeding a fluid, an apparatus 14 to be controlled, and a liquid source 15 in the plant 1. Further, the plant 1 may include the detection system 100 and the management terminal device 2.

The liquid source 15 stores the liquid to be supplied to the apparatus 14. The liquid source 15 may be a tank or the like that stores and reserves the liquid and maintains the pressure thereof. Alternatively, the liquid source 15 may be a water well or oil well established in an area where a resource, such as groundwater or oil field, is reserved or buried. Further, the liquid source 15 may be a river, pond, lake, dam, or the like. Further, the liquid source 15 may be a tank in which a liquid supplied by another pump is stored.

The pipe 11 is a pipe that connects the liquid source 15 to the apparatus 14 to circulate the liquid. The pipe 11 may be equipped with a valve or the like. The pipe 11 sends the liquid stored in the liquid source 15 to the apparatus 14. For example, the pipe 11 branches near the inlet port to the pump 12 and a pressure meter 13 is provided at one end. A branch pipe of the pipe 11 connected to the pressure meter 13 is called a pressure conduit pipe.

The pump 12 transfers or pressure-feeds the liquid stored in the liquid source 15 via the pipe 11, and supplies the liquid to the apparatus 14. The pump 12 is a positive displacement pump, for example. Alternatively, the pump 12 may be a spiral pump, diffuser pump, cascade pump, axial flow pump, oblique flow pump, cross flow pump, or the like. Further, a plurality of pumps 12 may be provided in the plant 1.

The pressure meter 13 is provided between the liquid source 15 and the pump 12 to measure the suction pressure of the pump 12. Specifically, the pressure meter 13 is provided at the end of the pressure conduit pipe branched from the pipe 11 connecting the liquid source 15 and the pump 12. For example, the pressure meter 13 is part of the existing equipment provided together with the installation of the pump 12. The pressure meter 13 functions as a sensor that detects the operation of the pump 12. In a case where a plurality of pumps 12 are present, each pump 12 may be provided with a pressure meter 13. FIG. 1 illustrates an example in which the liquid source 15, the pressure meter 13, and the pump 12 are provided one by one in the plant 1. Here, the measurement value obtained by the pressure meter 13 may be used to control the plant 1 as well.

The apparatus 14 may be a field apparatus installed at the site of the plant 1. The apparatus 14 may be at least part of a factory facility, machinery facility, production facility, power generation facility, storage facility, or the like. The apparatus 14 may be equipped with a device that receives supply of a liquid, such as water, oil, fuel, refrigerant or chemical, and performs a processing operation using the liquid. The apparatus 14 may be equipped with a plurality of devices.

The management terminal device 2 is a computer used by the administrator of the plant 1. The management terminal device 2 gives notice of cavitation occurrence to the administrator by, e.g., displaying information on the cavitation occurrence detected by a detection device 102.

Detection System

The detection system 100 detects cavitation, on the basis of a variation coefficient of the suction pressure data that indicates the unfiltered raw value of the suction pressure of the pump 12. The detection system 100 is configured to be applicable to an existing plant 1 or the like, and can detect cavitation by acquiring suction pressure data and obtaining a variation coefficient. Here, the detection system 100 may be included in the control system of the plant 1. Alternatively, the detection system 100 may be included in a measuring instrument, such as a sensor, provided in the plant 1.

Figure 2:
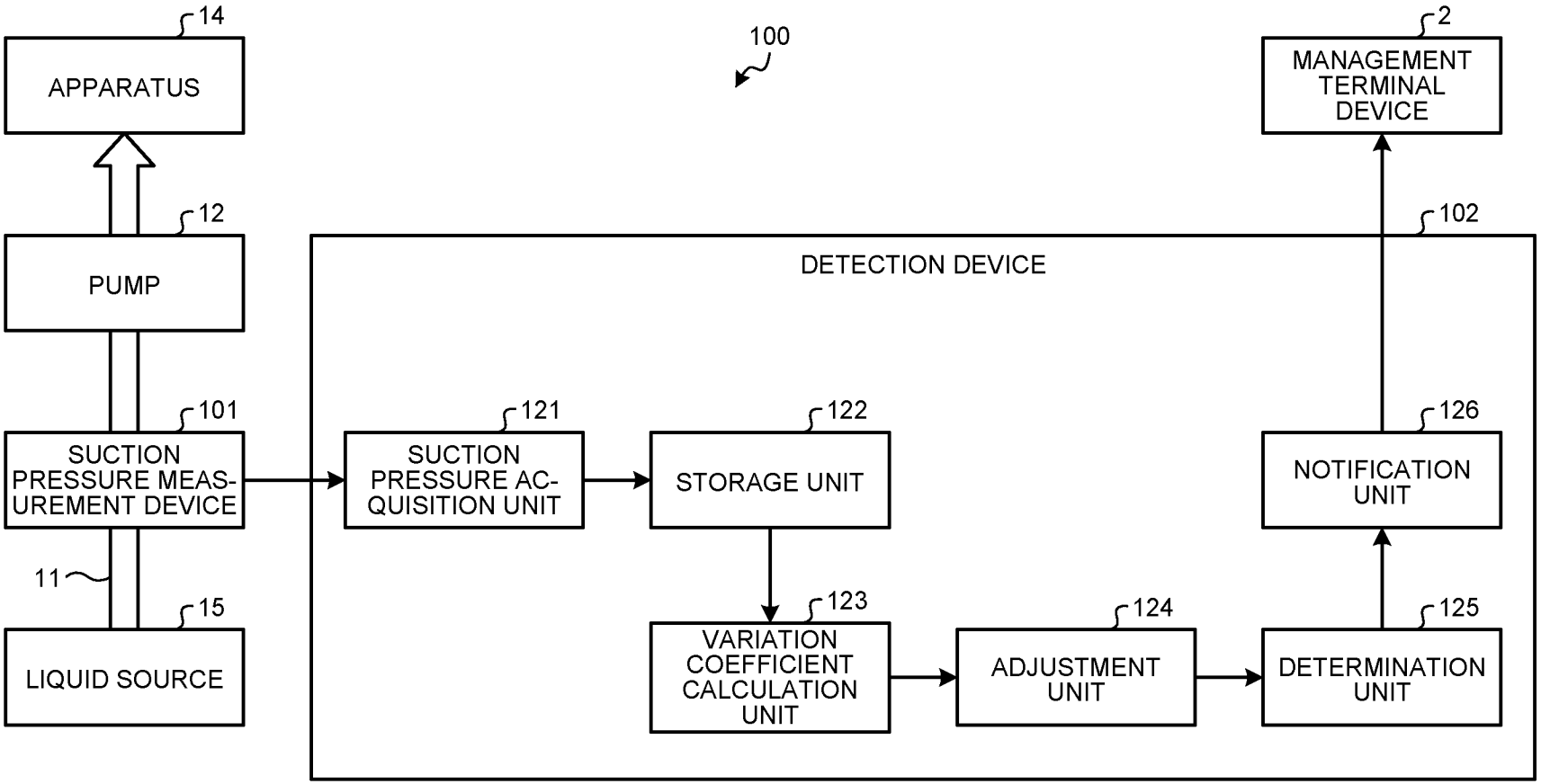
FIG. 2 is a block diagram illustrating details of the detection system.

FIG. 2 is a block diagram illustrating details of the detection system. Next, with reference to FIG. 2, an explanation will be given of the detection system 100 in detail. The detection system 100 includes a suction pressure measurement device 101 and a detection device 102 illustrated in FIG. 2. Here, in FIG. 2, an example of the direction of movement of the liquid inside the pipe 11 is illustrated by an arrow pointing from the liquid source 15 to the apparatus 14.

The suction pressure measurement device 101 is, for example, a differential pressure transmitter. For example, the suction pressure measurement device 101 is disposed at the leading end of a T-shaped joint, which is a branch pipe provided in the middle of the pressure conduit pipe. The suction pressure measurement device 101 is connected to send and receive data to and from the detection device 102 by analog or digital transmission.

The suction pressure measurement device 101 measures the suction pressure of the pump 12. Then, the suction pressure measurement device 101 converts the measurement value into suction pressure data that indicates the unfiltered raw value of the suction pressure. After that, the suction pressure measurement device 101 transmits the suction pressure data to the detection device 102 by high-speed digital communication.

Here, the detection device 102 according to this embodiment uses the suction pressure of the pump 12 as an example to detect cavitation occurrence. However, it is also possible to use another pressure related to the pump 12. For example, the detection device 102 may use the pressure around the pump 12 to detect cavitation occurrence. As the pressure around the pump 12, it is possible to use, for example, the priming water pressure, drain pressure, discharge pressure, or the like.

Detection Device

The detection device 102 is a controller of an instrumentation system that uses an unfiltered pressure raw value measured by the suction pressure measurement device 101 to detect cavitation occurrence. The detection device 102 is connected to the management terminal device 2 via a network. The detection device 102 includes a suction pressure acquisition unit 121, a storage unit 122, a variation coefficient calculation unit 123, an adjustment unit 124, a determination unit 125, and a notification unit 126.

The suction pressure acquisition unit 121 receives suction pressure data indicating the suction pressure of the pump 12 from the suction pressure measurement device 101. Further, when suction pressure data is stored in a database or the like, which is not illustrated, the suction pressure acquisition unit 121 may access this database or the like to acquire the suction pressure data. Alternatively, the suction pressure acquisition unit 121 may acquire the suction pressure data from the control system of the plant 1. The suction pressure acquisition unit 121 stores the acquired suction pressure data in the storage unit 122. This suction pressure acquisition unit 121 is an example of "pressure acquisition unit".

The storage unit 122 stores the suction pressure data acquired from the suction pressure acquisition unit 121. The storage unit 122 may store other data processed and/or to be processed by the detection device 102. For example, the storage unit 122 may individually store intermediate data, calculation results, parameters, etc. that are calculated and utilized in the process of generating the detection results by the detection device 102. In addition, in response to a request from each part in the detection device 102, the storage unit 122 may supply stored data to the requester. For example, in response to a request from the variation coefficient calculation unit 123, the storage unit 122 outputs stored suction pressure data to the variation coefficient calculation unit 123.

The variation coefficient calculation unit 123 calculates a variation coefficient of the suction pressure data for a detection target period. The variation coefficient is a value that indicates the amplitude of the suction pressure magnitude, and is one of the detection information to be used for cavitation occurrence detection. That is, on the basis of the suction pressure data acquired by the suction pressure acquisition unit 121, the variation coefficient calculation unit 123 calculates a variation coefficient that indicates the amplitude of the suction pressure magnitude.

For example, the variation coefficient calculation unit 123 calculates the variation coefficient on the basis of the average value and standard deviation of the suction pressure data for the detection target period. Specifically, the variation coefficient calculation unit 123 obtains the average value and standard deviation of the suction pressure data for the detection target period, and calculates a value obtained by dividing the standard deviation by the average value, as the variation coefficient. The variation coefficient is an index that indicates how much amplitude the pressure vibration has, where the pressure vibration indicates the fluctuation of the suction pressure. It can be said that, as the variation coefficient is larger, the suction pressure fluctuation is larger, and it is estimated that the increase in suction pressure fluctuation is due to cavitation occurrence. Therefore, the variation coefficient is a value that increases along with cavitation occurrence. In other words, where the pressure is properly transmitted to the detection device 102, it is estimated that cavitation has occurred when the variation coefficient becomes higher.

The variation coefficient calculation unit 123 may obtain, as the average value mentioned above, the moving average value of the suction pressure data for the detection target period, and may obtain, as the standard deviation mentioned above, the moving standard deviation of the suction pressure data. In this case, since the variation coefficient calculation unit 123 can sequentially obtain the variation coefficient of the suction pressure data while shifting the detection target period, it is possible to detect cavitation occurrence in the pump 12 at an early stage. The variation coefficient calculation unit 123 outputs the calculated variation coefficient to the adjustment unit 124.

For example, the variation coefficient calculation unit 123 uses the following formula (1) to calculate the variation coefficient $C_v$ of the suction pressure data during the detection target period. Here, $P_{adv}$ is the average value of the suction pressure data during the detection target period. Further, $S_p$ is the standard deviation of the suction pressure data during the detection target period.

$$C_v = \frac{S_p}{P_{adv}} \tag{1}$$

Further, the variation coefficient calculation unit 123 use the following formula (2) to calculate the standard deviation $S_p$ of the suction pressure data during the detection target period. Here, "n" is the number of data of the suction pressure data during the detection target period. Further, $P_i$ is the static pressure (suction pressure data) of the suction port of the pump 12.

$$S_p = \sqrt{\frac{1}{n}\sum_{i=1}^{n}(P_i - P_{adv})^2} \tag{2}$$

The adjustment unit 124 receives an input of the variation coefficient of the suction pressure data from the variation coefficient calculation unit 123. Here, the adjustment unit 124 holds in advance a pressure transmission coefficient, which is a coefficient for adjusting the variation coefficient in consideration of the ease of transmission for pressure vibration. The new coefficient considering the ease of transmission for pressure vibration is a parameter for properly detecting cavitation occurrence in a state where cavities or the like present inside due to cavitation hinder the transmission of vibration. By using the measurement value of the suction pressure and the observation result of the state of the pump 12, the pressure transmission coefficient is indirectly estimated from the suction pressure. The pressure transmission coefficient may be set to about 1/(the 2nd to 3rd power of the suction pressure) on the basis of statistical information. For example, the adjustment unit 124 may use 1/(the 3rd power) as the pressure transmission coefficient.

The adjustment unit 124 calculates an adjusted variation coefficient by multiplying the variation coefficient of the suction pressure data by the pressure transmission coefficient. After that, the adjustment unit 124 outputs the adjusted variation coefficient thus calculated to the determination unit 125. That is, the adjustment unit 124 performs adjustment using the pressure transmission coefficient that indicates the ease of transmission for suction pressure, onto the detection information to be used for cavitation occurrence detection, which includes the variation coefficient calculated by the variation coefficient calculation unit 123.

For example, where the pressure transmission coefficient is set to 1/(the 2nd to 3rd power of the suction pressure), the variation coefficient is multiplied by a large value when the pressure is low, and the variation coefficient is multiplied by a small value when the pressure is high. In other words, when the pressure is low, it is possible to increase the variation coefficient by multiplication.

In this respect, when the pressure is low, as cavitation occurrence becomes severe, cavities or the like present inside due to the cavitation hinder the transmission of vibration, and result in a variation coefficient smaller than the actual one. Accordingly, when the pressure is low, the adjustment unit 124 increases the variation coefficient by multiplication to adjust the variation coefficient to a proper value, and thereby enables the cavitation detection over a wide range of pressure. In this way, in order to convert the ease of transmission for pressure vibration, which is expressed as a temporal change (for example, an instantaneous change in every moment, as in a differential equation), into a variation coefficient, which is the variation amount in a certain time, the detection device 102 according to this embodiment multiplies the variation coefficient by about 1/(the 2nd to 3rd power of the pressure), and thereby calculates a new coefficient that considers the ease of transmission for pressure vibration, as the adjusted variation coefficient. Further, since this adjusted variation coefficient is used, the detection device 102 can apply the same index in any pressure zone.

The determination unit 125 receives an input of the adjusted variation coefficient from the variation coefficient calculation unit 123. The determination unit 125 determines that cavitation has occurred in the pump 12 when the adjusted variation coefficient thus acquired exceeds a reference variation coefficient determined in advance. The reference variation coefficient is a threshold value used for cavitation occurrence detection. Here the determination unit 125 may use, as the reference variation coefficient mentioned above, a variation coefficient of the suction pressure data acquired by the suction pressure acquisition unit 121 before the detection target period described above, or a coefficient obtained by performing a predetermined arithmetic operation (for example, multiplication of a predetermined constant) onto this variation coefficient.

For example, the determination unit 125 may use, as the reference variation coefficient mentioned above, a coefficient obtained by multiplying a certain value to a variation coefficient of the suction pressure data obtained in a state in which the operation is stable after the pump 12 starts to operate and a certain amount of time, such as about several tens of seconds to several minutes, has passed. Here, "the state in which the operation is stable" means, for example, a state in which the variation of the suction pressure data of the pump 12 falls within a certain value range. Further, the determination unit 125 may repeatedly set the reference variation coefficient at predetermined timings according to the operational status of the pump 12 or the apparatus 14, for example.

The determination unit 125 gives notice of cavitation occurrence detection to the notification unit 126. Further, the determination unit 125 may also give notice of no cavitation detection to the notification unit 126.

The notification unit 126 receives notice of cavitation detection from the determination unit 125. Then, the notification unit 126 transmits cavitation detection information to the management terminal device 2, to report the cavitation occurrence to the administrator. Further, the notification unit 126 may also give notice of the cavitation occurrence to the control system of the plant 1.

Figure 3:
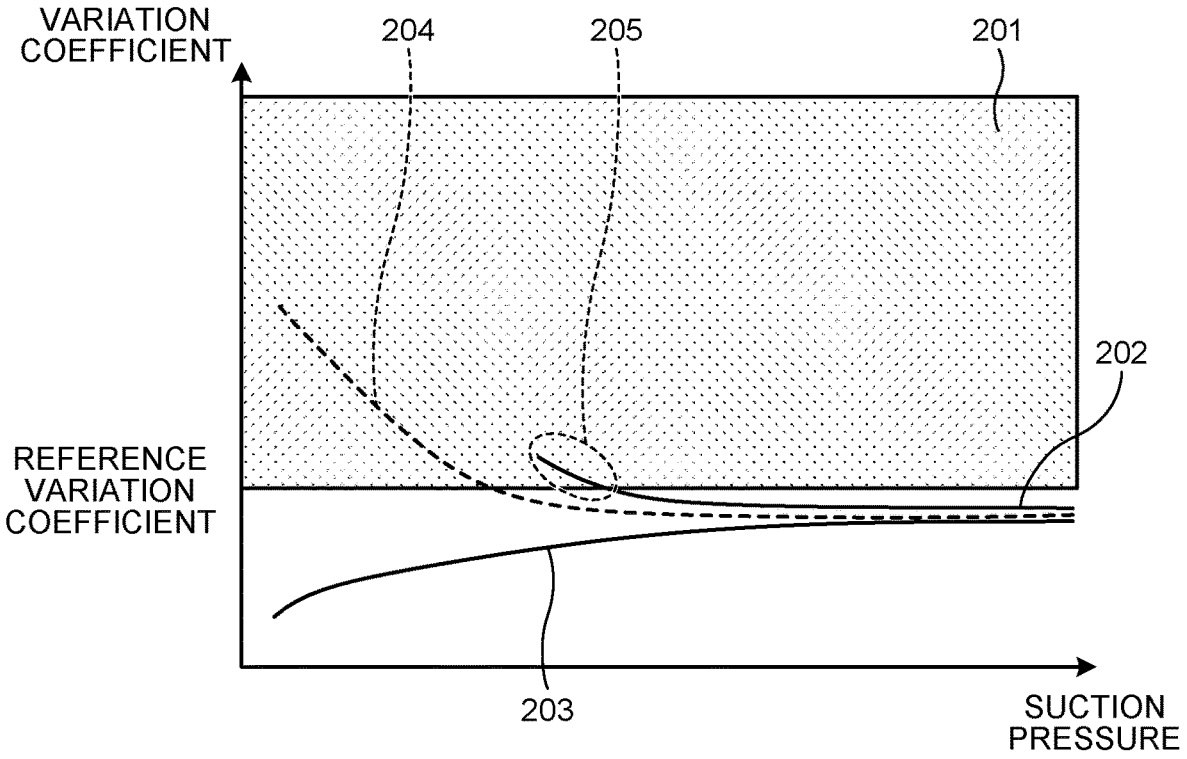
FIG. 3 is a diagram illustrating an example of cavitation detection using an adjusted variation coefficient.

FIG. 3 is a diagram illustrating an example of cavitation detection using the adjusted variation coefficient. In FIG. 3, the horizontal axis represents the suction pressure and the vertical axis represents the variation coefficient. The region above the reference variation coefficient is a cavitation occurrence region 201. A curve 202 represents the variation coefficient calculated by the variation coefficient calculation unit 123 when a centrifugal pump is used. A curve 203 represents the variation coefficient calculated by the variation coefficient calculation unit 123 when a positive displacement pump is used. In the case of the centrifugal pump, as illustrated by the curve 202, since the variation coefficient at an area 205 comes into the cavitation occurrence region 201, cavitation is detected.

On the other hand, in the case of the positive displacement pump, as illustrated by the curve 203, the variation coefficient calculated when the pressure is low does not come into the cavitation occurrence region 201. This is because, when the pressure is low, the saturated vapor due to cavitation does not disappear, so the pressure is not accurately transmitted to the detection device 102, and the variation coefficient calculation unit 123 calculates the variation coefficient to be lower. Therefore, the adjustment unit 124 multiplies the pressure transmission coefficient to the variation coefficient calculated by the variation coefficient calculation unit 123, and thereby calculates an adjusted variation coefficient as illustrated by a curve 204. In the case of the curve 204 representing the adjusted variation coefficient, even when the pressure is low and the pressure is not accurately transmitted, the adjusted variation coefficient comes into the cavitation occurrence region 201. Therefore, the determination unit 125 can detect cavitation even when the pressure is low.

Detection Process Flow

Figure 4:
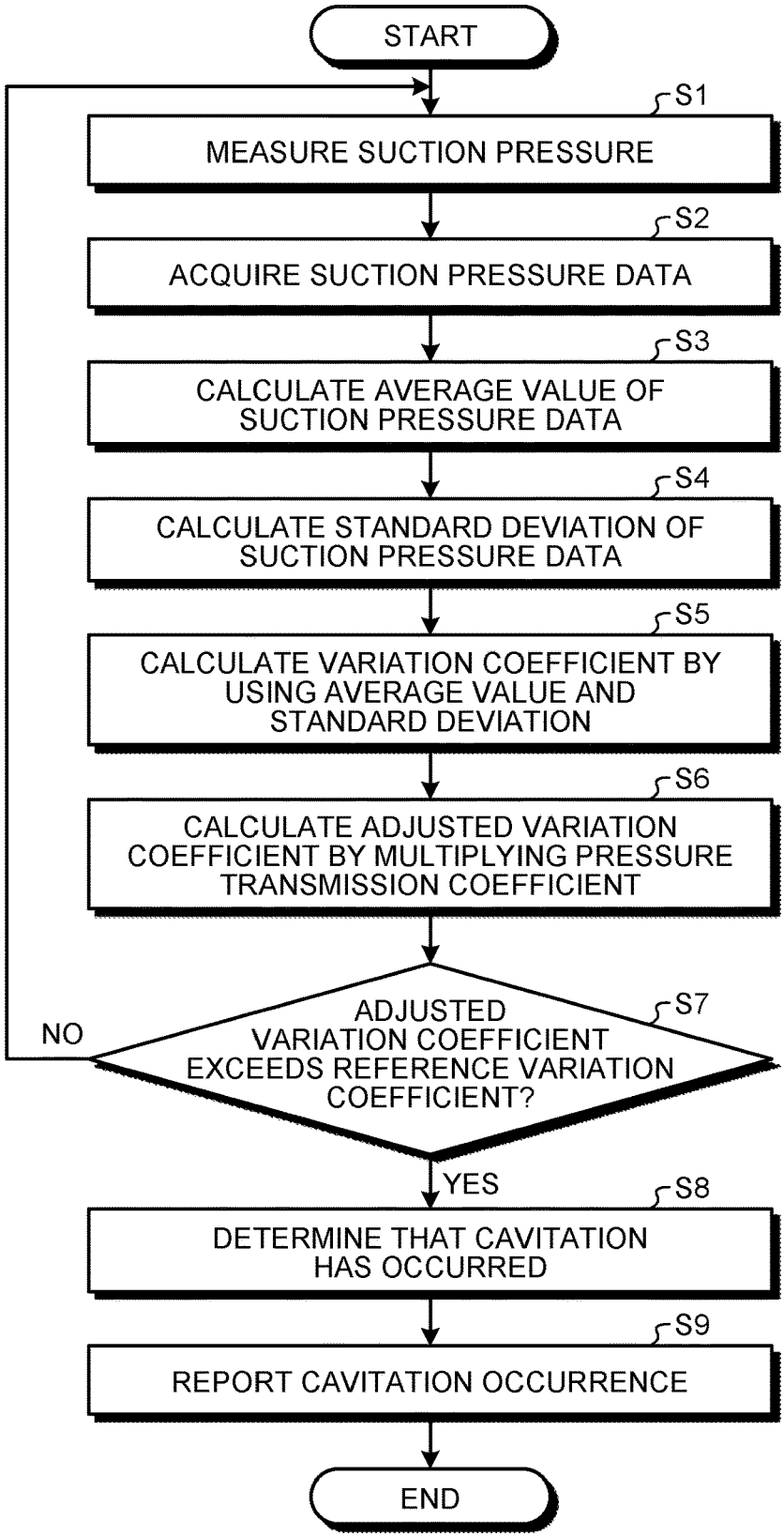
FIG. 4 is a flowchart illustrating a process of detecting cavitation occurrence by a detection system according to a first embodiment.

FIG. 4 is a flowchart illustrating a process of detecting cavitation occurrence by the detection system according to the first embodiment. Next, with reference to FIG. 4, an explanation will be given of the flow of the process of detecting cavitation occurrence by the detection system 100 according to the first embodiment.

The suction pressure measurement device 101 measures the suction pressure of the pump 12 (step S1). Then, the suction pressure measurement device 101 transmits the measurement result to the detection device 102 as suction pressure data.

The suction pressure acquisition unit 121 acquires the suction pressure data transmitted from the suction pressure measurement device 101 (step S2). Then, the suction pressure acquisition unit 121 stores the suction pressure data in the storage unit 122.

The variation coefficient calculation unit 123 acquires the suction pressure data for a detection target period from the storage unit 122. Then, the variation coefficient calculation unit 123 calculates the average value of the suction pressure data (step S3).

Then, the variation coefficient calculation unit 123 calculates the standard deviation of the suction pressure data (step S4).

Then, the variation coefficient calculation unit 123 calculates a variation coefficient by using the average value and the standard deviation (step S5). Then, the variation coefficient calculation unit 123 outputs the calculated variation coefficient to the adjustment unit 124.

The adjustment unit 124 calculates an adjusted variation coefficient by multiplying the pre-existing pressure transmission coefficient to the variation coefficient (step S6). As the pressure transmission function, for example, a value of about 1/(the 2nd to 3rd power of the suction pressure data) may be used. Then, the adjustment unit 124 outputs the adjusted variation coefficient thus calculated to the determination unit 125.

The determination unit 125 determines whether the adjusted variation coefficient acquired from the adjustment unit 124 exceeds a reference variation coefficient determined in advance (step S7). When the adjusted variation coefficient is less than or equal to the reference variation coefficient (step S7: No), the determination unit 125 determines that cavitation has not occurred. Then, the detection process returns to step S1.

On the other hand, when the adjusted variation coefficient exceeds the reference variation coefficient (step S7: Yes), the determination unit 125 determines that cavitation has occurred (step S8). Then, the determination unit 125 gives notice of the cavitation detection to the notification unit 126.

Then, upon reception of the notice of the cavitation detection, the notification unit 126 transmits cavitation occurrence information to the management terminal device 2, to report the cavitation occurrence to the administrator (step S9).

Effect

As explained above, the detection device 102 according to this embodiment uses the raw value of the suction pressure to calculate a variation coefficient of the suction pressure of the pump 12, and further, in order to consider the ease of transmission for pressure vibration, uses the pressure transmission coefficient to calculate an adjusted variation coefficient, in which the variation coefficient has been adjusted. Then, the detection device 102 compares the adjusted variation coefficient thus calculated with a reference variation coefficient to detect cavitation.

Since the positive displacement pump is high in suction force, the pump suction pressure is generally lower than that of the centrifugal pump under conditions where the inflow rate to the pump is small. By the way, in the case of the centrifugal pump, under such conditions, when the pump tries to suck in the fluid, the pump cannot suck in well, and the pump suction pressure generally does not decrease. Under conditions where the pump suction pressure is low as in the positive displacement pump described above, cavities due to cavitation can be hardly undone in the pump but can be easily undone at the exit. That is, the region of cavities becomes larger inside the pump. Since these cavities spread in the pump act as a cushion and cause absorption and reflection of pressure, it becomes difficult for the pressure variation to be accurately transmitted to the sensor. Thus, the detection device comes to calculate the pressure variation coefficient to be lower.

As described above, in the case of the conventional detection device, when the pressure is remarkably low globally or locally in the pump, there is a possibility that the variation coefficient used for determining cavitation occurrence ends up being small even though the liquid is disturbed by cavitation occurrence and the pressure variation is large. Therefore, it is difficult for the conventional detection device to accurately detect cavitation occurrence.

On the other hand, the detection device 102 according to this embodiment can detect cavitation occurrence even when the pressure is remarkably low globally or locally in the pump 12. Therefore, it is possible to improve the accuracy of cavitation occurrence detection. In particular, when a positive displacement pump is used as the pump 12, it is possible to improve the accuracy of cavitation occurrence detection.

Figure 5:
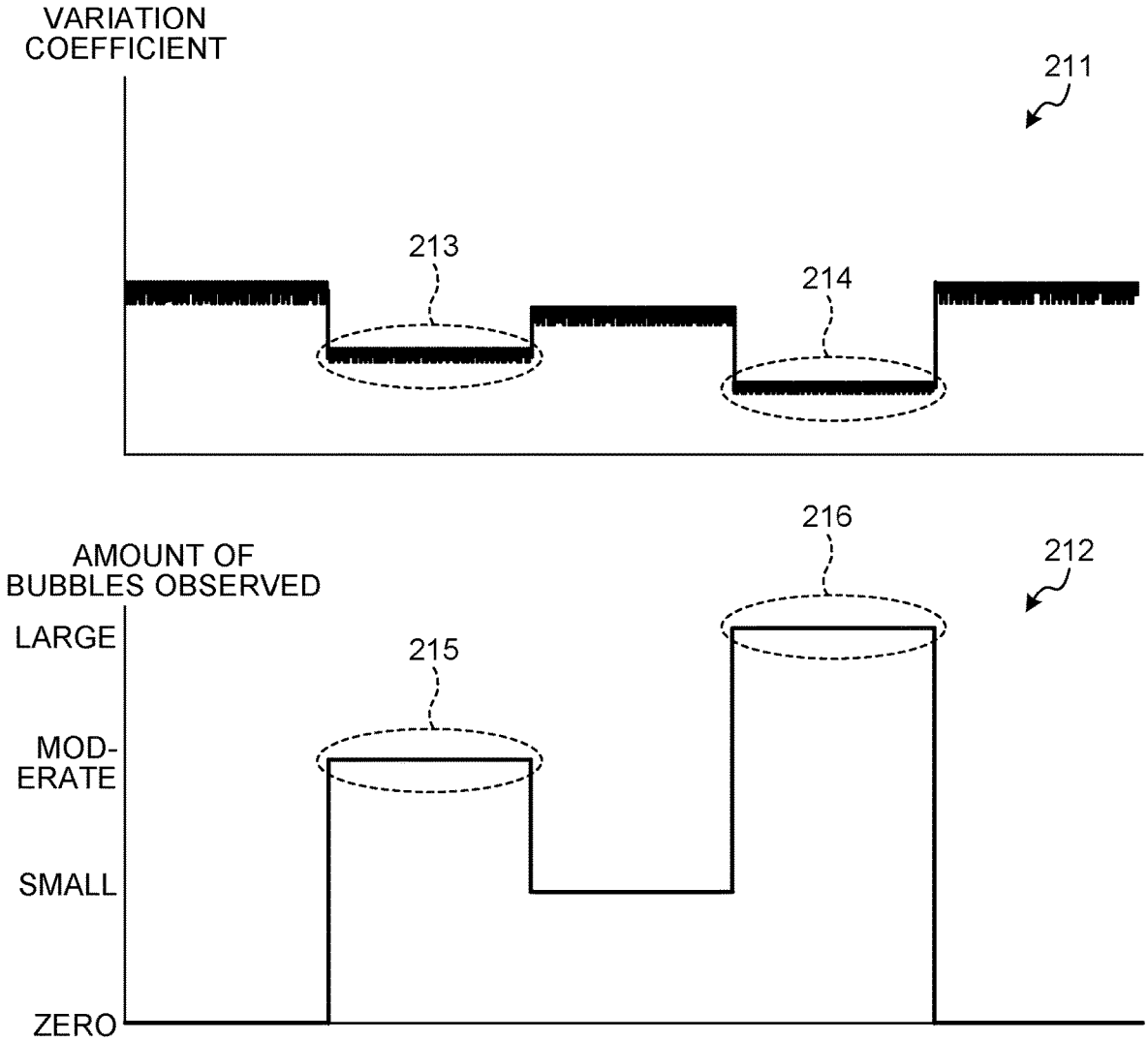
FIG.5 Prior Art
FIG. 5 is a diagram illustrating calculation of a variation coefficient by a conventional detection device.
Figure 6:
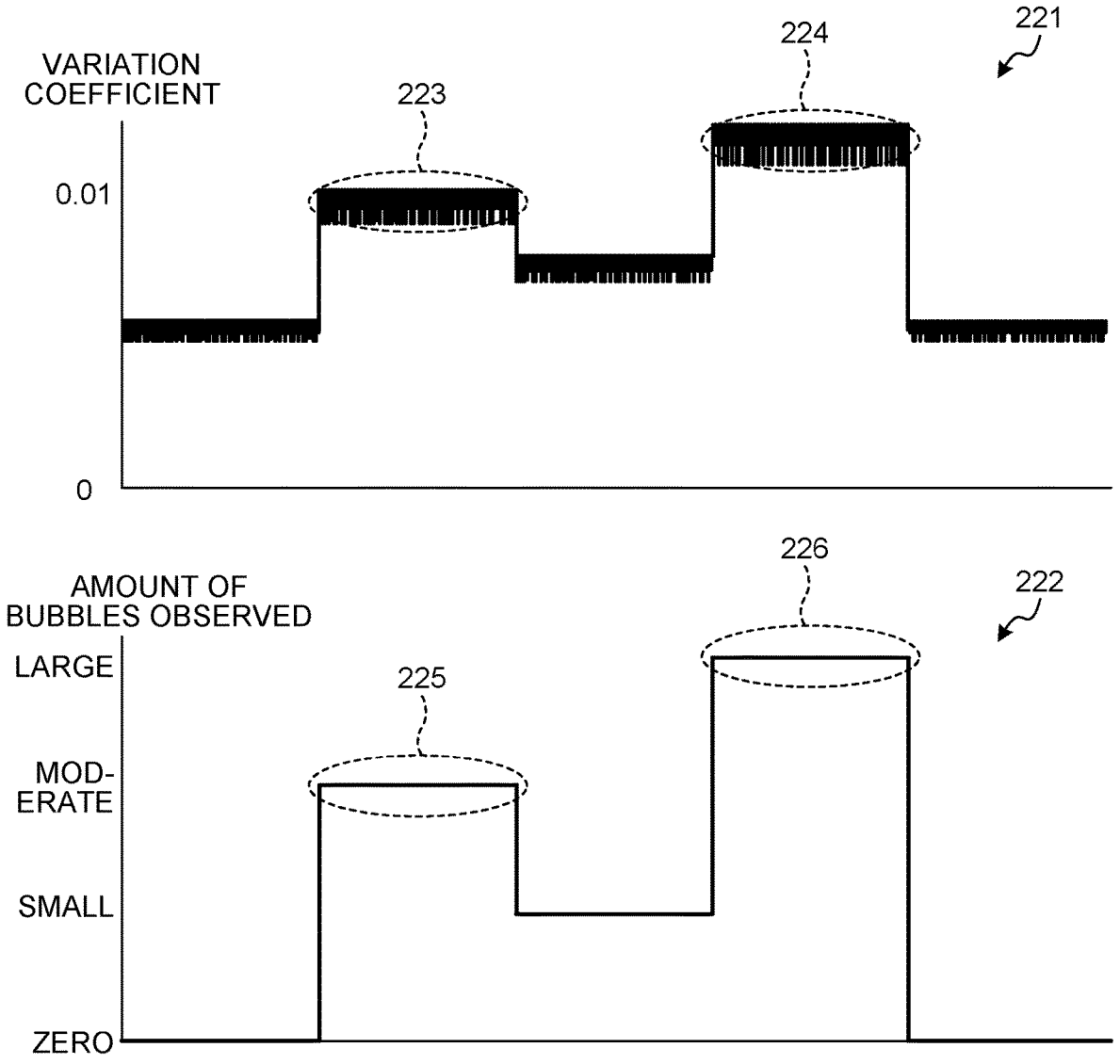
FIG. 6 is a diagram illustrating calculation of a variation coefficient by a detection device according to the first embodiment.

FIG. 5 is a diagram illustrating calculation of a variation coefficient by the conventional detection device. FIG. 6 is a diagram illustrating calculation of a variation coefficient by the detection device according to the first embodiment. Here, with reference to FIGS. 5 and 6, an explanation will be given of the improvement of cavitation detection accuracy by the detection device 102 according to this embodiment. In a graph 211 of FIG. 5, the horizontal axis represents the passage of time and the vertical axis represents the variation coefficient. In a graph 221 of FIG. 6, the horizontal axis represents the passage of time and the vertical axis represents the adjusted variation coefficient. Further, in a graph 212 of FIG. 5 and a graph 222 of FIG. 6, the horizontal axis represents the passage of time, and the vertical axis represents the amount of bubbles observed inside the pump 12. FIGS. 5 and 6 illustrate the results of observing gas bubbles over time under the same conditions.

In the case of a detection device of the conventional type that uses a variation coefficient without adjustment to detect cavitation, the variation coefficient is small in a period 213 in the graph 211 of FIG. 5, but a moderate amount of bubbles is observed in the corresponding period 215 in the graph 212. Similarly, the variation coefficient is small in a period 214 in the graph 211, but a large amount of bubbles is observed in the corresponding period 216 in the graph 212. In other words, even though cavitation has occurred actually as illustrated in the periods 215 and 216, the detection device of the conventional type cannot detect cavitation because the variation coefficient is small in the periods 213 and 214. This is because the suction pressure is not transmitted due to gas bubbles large in quantity in a state where the suction pressure is remarkably low.

On the other hand, in the case of the detection device 102 according to this embodiment, there is a moderate amount of bubbles generated in a period 225 in the graph 222 of FIG. 6 as in the period 215 in the graph 211 of FIG. 5, and the adjusted variation coefficient in the corresponding period 223 in the graph 221 takes a large value. Similarly, there is a large amount of bubbles generated in a period 226 in the graph 222 of FIG. 6 as in the period 216 in the graph 211 of FIG. 5, and the adjusted variation coefficient in the corresponding period 224 in the graph 221 takes a large value. That is, even when the generation of gas bubbles is large in a state where the suction pressure is remarkably low, the detection device 102 according to this embodiment calculates the adjusted variation coefficient as a large value, and makes it possible to detect cavitation, as illustrated in the periods 223 and 224. In this way, the detection device 102 according to this embodiment can detect cavitation occurrence even when the suction pressure is remarkably low, and can thereby improve the accuracy of cavitation occurrence detection.

Second Embodiment

Next, an explanation will be given of a second embodiment. The detection device 102 according to this embodiment sets lower the reference variation coefficient and expands the cavitation occurrence region, in accordance with a decrease of the suction pressure, to detect cavitation occurrence when the suction pressure is remarkably low. The detection device 102 according to this embodiment is also illustrated by the block diagram of FIG. 2. In the following description, the explanation for the operations of respective parts which are the same as those of the first embodiment will be omitted.

The adjustment unit 124 receives an input of the variation coefficient of the suction pressure data from the variation coefficient calculation unit 123. The adjustment unit 124 according to this embodiment holds in advance a pressure transmission coefficient for cavitation region adjustment, which is a coefficient for adjusting the reference variation coefficient in consideration of the ease of transmission for pressure vibration. This pressure transmission coefficient for cavitation region adjustment is estimated indirectly from the measurement value of the suction pressure and the observation result of the state of the pump 12. The pressure transmission coefficient for cavitation region adjustment may be expressed as a function of the suction pressure that approaches 1 as the suction pressure becomes higher and approaches 0 as the suction pressure becomes lower.

In addition, in this embodiment, the adjustment unit 124 has a reference variation coefficient determined in advance. Here, the adjustment unit 124 multiplies the reference variation coefficient by a pressure transmission coefficient for cavitation region adjustment according to the suction pressure to calculate an adjusted reference variation coefficient. In this way, the adjustment unit 124 changes the cavitation occurrence region 201 to be expanded downward as the suction pressure is lower. Then, the adjustment unit 124 outputs the adjusted reference variation coefficient thus calculated, along with the variation coefficient, to the determination unit 125.

That is, the reference variation coefficient is one of the detection information used to detect cavitation occurrence. Here, the adjustment unit 124 adjusts the reference variation coefficient, which is a threshold value to be used for cavitation occurrence detection, determined in advance and included in the detection information, and calculates an adjusted reference variation coefficient.

The determination unit 125 receives an input of the variation coefficient and the adjusted reference variation coefficient from the variation coefficient calculation unit 123. Then, the determination unit 125 compares the acquired variation coefficient and the adjusted reference variation coefficient with each other. When the variation coefficient exceeds the adjusted reference variation coefficient thus calculated, the determination unit 125 determines that cavitation has occurred in the pump 12. Since the cavitation occurrence region 201 is adjusted such that the adjusted reference variation coefficient is lower when the pressure is low, the determination unit 125 can detect cavitation, even when the variation coefficient comes to be calculated smaller because the suction pressure is low and the pressure can be hardly transmitted properly.

As explained above, the detection device 102 according to this embodiment uses the pressure transmission coefficient for cavitation region adjustment to adjust the basic variation coefficient. In this way, the basic variation coefficient is adjusted to expand the cavitation occurrence region when the pressure is low. In this case also, it becomes possible to detect cavitation occurrence when the pressure is remarkably low globally or locally in the pump 12. Therefore, where a method of expanding the cavitation occurrence region is used as in the detection device 102 according to this embodiment, it is also possible to improve the accuracy of cavitation occurrence detection.

Third Embodiment

Figure 7:
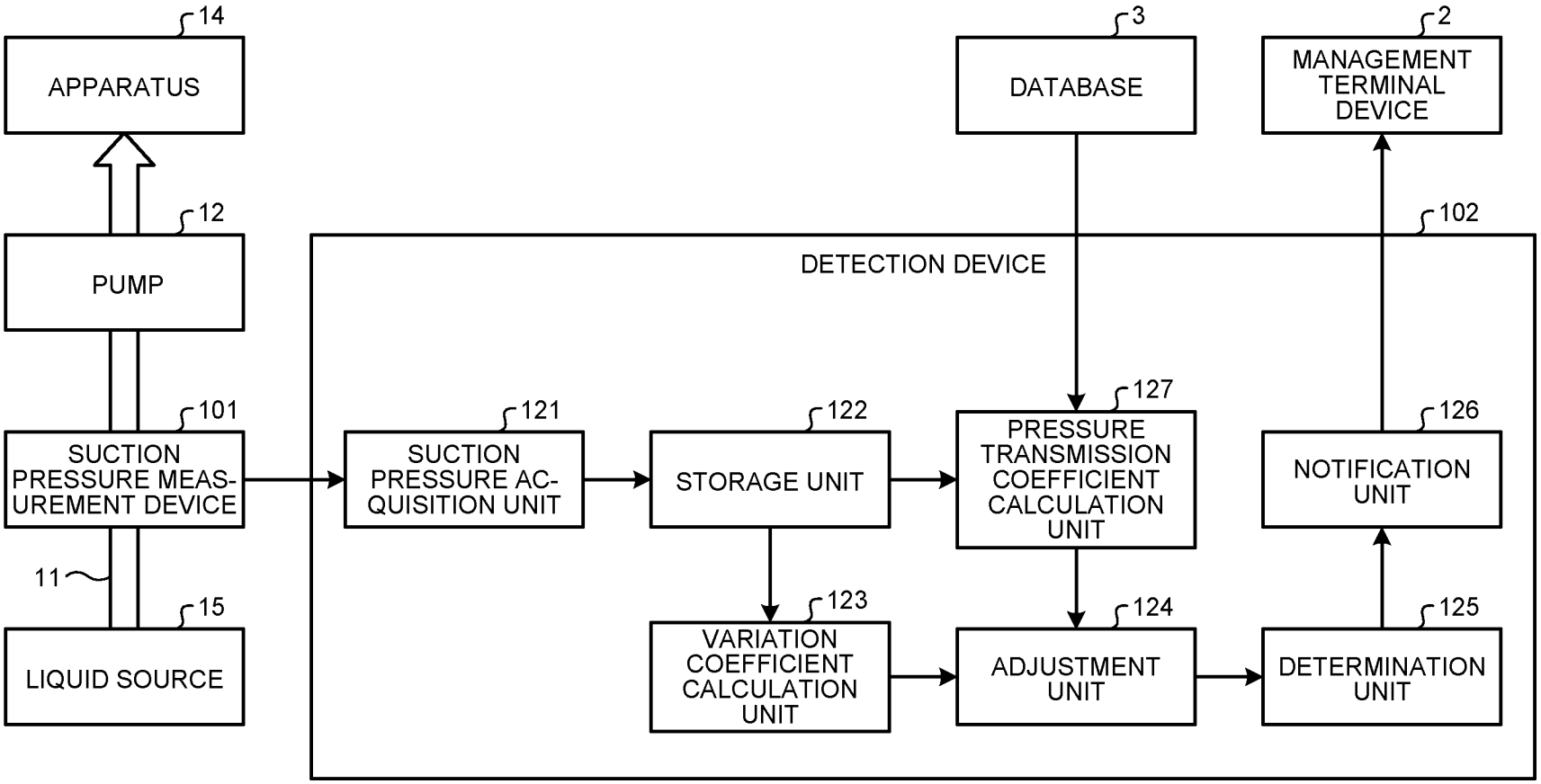
FIG. 7 is a block diagram illustrating details of a detection system according to a third embodiment.

Next, an explanation will be given of a third embodiment. In each of the embodiments described above, the adjustment unit 124 holds in advance the pressure transmission coefficient estimated indirectly from the suction pressure by using the relationship between the suction pressure and the generation amount of bubbles. In this embodiment, a detection device 102 calculates the pressure transmission coefficient. FIG. 7 is a block diagram illustrating details of a detection system according to the third embodiment. The detection device 102 included in the detection system 100 according to this embodiment includes a pressure transmission coefficient calculation unit 127 in addition to the respective units illustrated in FIG. 2. In the following description, the explanation for the functions of respective parts which are the same as those of the first embodiment will be omitted.

A database 3 holds past statistical information on the pump 12. For example, the database 3 stores the suction pressure of the pump 12, the state observation results, such as the amount of bubbles in the pump 12, etc. in correlation with each other as information for each time point.

The pressure transmission coefficient calculation unit 127 acquires the statistical information on the pump 12 from the database 3. Then, the pressure transmission coefficient calculation unit 127 uses the statistical information on the pump 12 thus acquired to calculate a pressure transmission coefficient that is used for considering the ease of pressure transmission.

For example, the pressure transmission coefficient calculation unit 127 performs machine learning by artificial intelligence (AI) while using the measurement value of the suction pressure and the observation result of the amount of bubbles in the pump 12, as learning data, to create a machine learning model that sets the suction pressure as input and the pressure transmission coefficient as output. Then, the pressure transmission coefficient calculation unit 127 acquires the suction pressure from the storage unit 122, and inputs the acquired suction pressure to the machine learning model and thereby acquires a pressure transmission coefficient. Then, the pressure transmission coefficient calculation unit 127 outputs the obtained pressure transmission coefficient to the adjustment unit 124.

Other than the above, the pressure transmission coefficient calculation unit 127 may calculate the pressure transmission coefficient by the following method.

For example, the pressure transmission coefficient calculation unit 127 may calculate the pressure transmission coefficient indirectly from the flow rate by using the relationship between the dynamic pressure obtained from the flow rate and the static pressure obtained from the suction pressure. The calculation principle of this pressure transmission function will be explained below. The energy of liquid consists of dynamic pressure and static pressure, where the dynamic pressure can be measured as a flow rate and the static pressure as a side surface pressure. Here, Bernoulli's theorem is "a theorem indicating that the energy is conserved on streamlines, in a steady flow of an ideal fluid". Therefore, it is possible for the pressure transmission coefficient calculation unit 127 to estimate the tendency of the pressure from the flow rate with reference to Bernoulli's theorem, and thereby to obtain the pressure variation coefficient and a new coefficient that considers the ease of transmission for pressure vibration. Specifically, the pressure transmission coefficient calculation unit 127 can calculate the pressure transmission function, on the basis of the fact that the density inside the fluid is reduced by the generation of cavities due to cavitation and the relationship between the dynamic pressure and the static pressure is thereby destroyed. Further, the variation coefficient calculation unit 123 may also calculate the pressure transmission coefficient from the flow rate by using the relationship between the dynamic pressure obtained from the flow rate and the static pressure obtained from the suction pressure.

Alternatively, the pressure transmission coefficient calculation unit 127 may calculate the pressure transmission coefficient from the relationship between the time from the start of operation of the pump 12 to the stop of the operation and the suction pressure. The calculation principle of this pressure transmission function will be explained below. Ideally, the pressure changes in accordance with the timing when the pump 12 starts to operate. However, actually, the pressure change is deviated by the distance from the pump 12 to the suction pressure measurement device 101 and the pressure transmission of the liquid. For example, when cavitation occurs, many cavities are generated due to bubbles, so the viscosity of the liquid becomes lower and the pressure transmission speed becomes slower. Therefore, it is possible for the pressure transmission coefficient calculation unit 127 to obtain the ease of transmission for pressure vibration by using the deviation of this pressure change, and thereby to calculate the pressure transmission coefficient on the basis of the obtained ease of transmission for pressure vibration.

Alternatively, the pressure transmission coefficient calculation unit 127 may calculate the pressure transmission coefficient from the basic information of the fluid, such as the temperature, viscosity, density, etc. of the fluid. The pressure transmission coefficient calculation unit 127 can calculate the pressure transmission coefficient from one of the basic information or a combination thereof. The calculation principle of this pressure transmission function will be explained below. Depending on the temperature, viscosity, and/or density of the liquid, the ease of cavity generation in the liquid under low pressure is changed. For example, in a liquid with a low boiling point, it is less likely to generate severe cavities that hinder the pressure transmission, due to cavitation. On the other hand, when the temperature is high, it becomes easier to generate severe cavities that hinder the pressure transmission, due to cavitation. In this way, it is possible for the pressure transmission coefficient calculation unit 127 to infer the ease of transmission for pressure vibration from the basic information of the liquid, and thereby to calculate the pressure transmission coefficient.

Alternatively, the pressure transmission coefficient calculation unit 127 may calculate the pressure transmission coefficient on the basis of the information of a pressure gauge disposed farther from the pump 12 than the suction pressure measurement device 101. The calculation principle of this pressure transmission function will be explained below. Ideally, pressure changes are transmitted from the preceding stage to the succeeding stage in the process. By utilizing this pressure transmission to compare the change in the value of the pressure gauge disposed farther than the suction pressure measurement device 101, it is possible for the pressure transmission coefficient calculation unit 127 to obtain the ease of transmission for pressure vibration, and thereby to calculate the pressure transmission coefficient. For example, when cavitation occurs at a bending or the like of the pipe 11, the fluid density changes. Therefore, the pressure transmission coefficient calculation unit 127 can estimate that the liquid density has changed, on the basis of the difference in pressure change timing, and make it possible to obtain the ease of transmission for pressure vibration and calculate the pressure transmission coefficient.

Here, the pressure transmission coefficient calculation unit 127 may calculate the pressure transmission coefficient in advance, or may calculate the pressure transmission coefficient at each time when the variation coefficient calculation unit 123 calculates the variation coefficient. Further, the pressure transmission coefficient calculation unit 127 may repeat to calculate the pressure transmission coefficient periodically or when certain conditions are met.

Detection Process Flow

Figure 8:
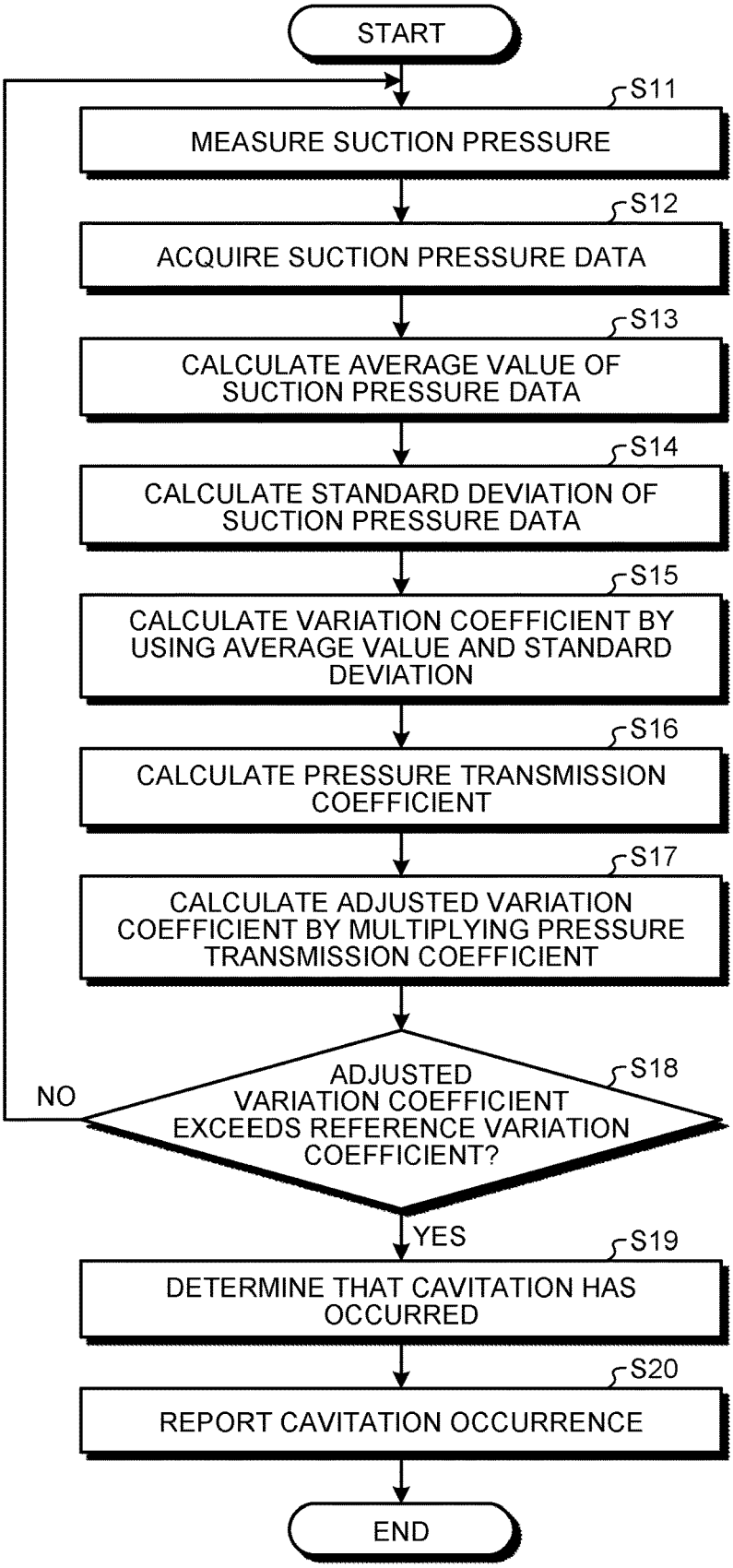
FIG. 8 is a flowchart illustrating a process of detecting cavitation occurrence by a detection system according to a third embodiment.

FIG. 8 is a flowchart illustrating a process of detecting cavitation occurrence by the detection system according to the third embodiment. Next, with reference to FIG. 8, an explanation will be given of the flow of the process of detecting cavitation occurrence by the detection system 100 according to the third embodiment.

The suction pressure measurement device 101 measures the suction pressure of the pump 12 (step S11). Then, the suction pressure measurement device 101 transmits the measurement result to the detection device 102 as suction pressure data.

The suction pressure acquisition unit 121 acquires the suction pressure data transmitted from the suction pressure measurement device 101 (step S12). Then, the suction pressure acquisition unit 121 stores the suction pressure data in the storage unit 122.

The variation coefficient calculation unit 123 acquires the suction pressure data for a detection target period from the storage unit 122. Then, the variation coefficient calculation unit 123 calculates the average value of the suction pressure data (step S13).

Then, the variation coefficient calculation unit 123 calculates the standard deviation of the suction pressure data (step S14).

Then, the variation coefficient calculation unit 123 calculates a variation coefficient by using the average value and the standard deviation (step S15). Then, the variation coefficient calculation unit 123 outputs the calculated variation coefficient to the adjustment unit 124.

The pressure transmission coefficient calculation unit 127 acquires the past statistical information for the pump 12 from the database 3, and calculates a pressure transmission coefficient on the basis of the suction pressure data (step S16). For example, the adjustment unit 124 performs machine learning from the past statistical information to create a machine learning model, and inputs the suction pressure data into the created machine learning model to calculate a pressure transmission coefficient. Then, the pressure transmission coefficient calculation unit 127 outputs the calculated pressure transmission coefficient to the adjustment unit 124.

Then, the adjustment unit 124 calculates an adjusted variation coefficient by multiplying the variation coefficient acquired from the variation coefficient calculation unit 123 by the pressure transmission coefficient acquired from the pressure transmission coefficient calculation unit 127 (step S17). Then, the adjustment unit 124 outputs the adjusted variation coefficient thus calculated to the determination unit 125.

The determination unit 125 determines whether the adjusted variation coefficient acquired from the adjustment unit 124 exceeds a reference variation coefficient determined in advance (step S18). When the adjusted variation coefficient is less than or equal to the reference variation coefficient (step S18: No), the determination unit 125 determines that cavitation has not occurred. Then, the detection process returns to step S11.

On the other hand, when the adjusted variation coefficient exceeds the reference variation coefficient (step S18: Yes), the determination unit 125 determines that cavitation has occurred (step S19). Then, the determination unit 125 gives notice of the cavitation detection to the notification unit 126.

Then, upon reception of the notice of the cavitation detection, the notification unit 126 transmits cavitation occurrence information to the management terminal device 2, to report the cavitation occurrence to the administrator (step S20).

As explained above, the detection device 102 according to this embodiment calculates a pressure transmission coefficient and uses the calculated pressure transmission coefficient to adjust the variation coefficient. This makes it easier to calculate the pressure transmission coefficient in accordance with the state of the pump 12. Therefore, it is possible to detect cavitation by using the pressure transmission coefficient according to the state of the pump 12, and thereby to detect cavitation occurrence more accurately.

System

The processing sequences, the control sequences, the specific names, and the information including various data and parameters disclosed in the above description and the drawings may be arbitrarily changed unless otherwise specified.

Further, each of the constituent elements of each of the illustrated devices is functionally conceptual, and is not necessarily required to be physically configured as illustrated. That is, the specific form of separation or integration of each device is not limited to the illustrated form. In other words, all or a part of each device may be functionally or physically separated or integrated in arbitrary units in accordance with various processing loads and/or usage situations.

For example, the detection device 102 may incorporate all or part of the functions of the suction pressure measurement device 101. Further, the detection device 102 may be included in the management terminal device 2.

Further, all or any part of each processing function to be performed in each device may be implemented by a central processing unit (CPU) and a program that is analyzed and executed by the CPU, or may be implemented as hardware by wired logic.

Hardware

Figure 9:
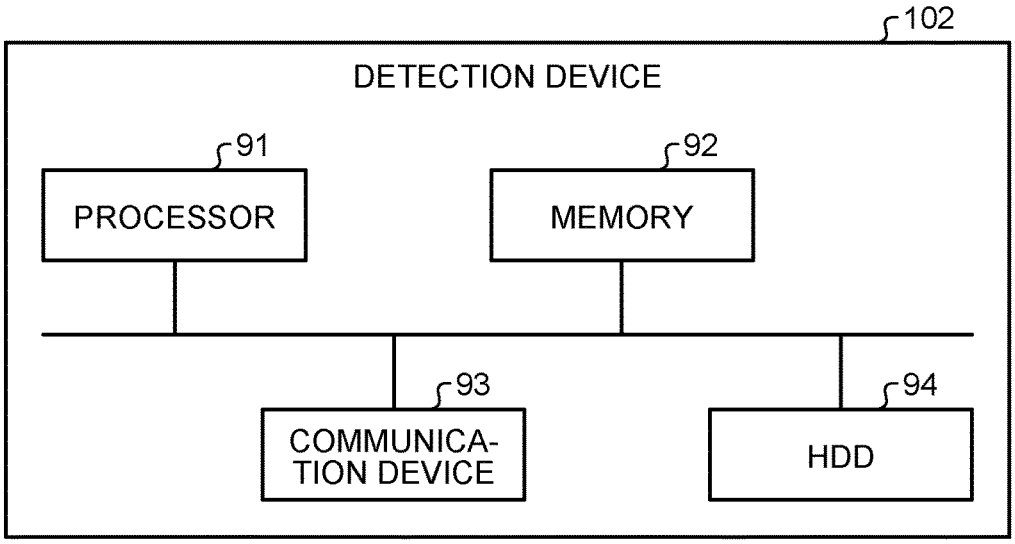
FIG. 9 is a hardware configuration diagram of the detection device.

Next, an explanation will be given of a hardware configuration example of the detection device 102. FIG. 9 is a hardware configuration diagram of the detection device. As illustrated in FIG. 9, the detection device 102 includes a processor 91, a memory 92, a communication device 93, and a hard disk drive (HDD) 94. Further, the processor 91 is connected to the memory 92, the communication device 93, and the HDD 94 via a bus.

The communication device 93 is a network interface card or the like, and is used for communications with other information processing devices. For example, the communication device 93 relays communication between the processor 91 and the suction pressure measurement device 101 and management terminal device 2.

The HDD 94 is an auxiliary storage device. The HDD 94 implements the function of the storage unit 122 illustrated in FIG. 2. The HDD 94 also stores various programs, including programs that implement the functions of the suction pressure acquisition unit 121, the variation coefficient calculation unit 123, the adjustment unit 124, the determination unit 125, and the notification unit 126, illustrated in FIG. 2. Alternatively, the HDD 94 may store various programs, including programs that implement the functions of the suction pressure acquisition unit 121, the variation coefficient calculation unit 123, the adjustment unit 124, the determination unit 125, the notification unit 126, and the pressure transmission coefficient calculation unit 127, illustrated in FIG. 7.

The processor 91 reads various programs stored in the HDD 94, develops them to the memory 92, and executes them. As a result, the processor 91 implements the functions of the suction pressure acquisition unit 121, the variation coefficient calculation unit 123, the adjustment unit 124, the determination unit 125, and the notification unit 126, illustrated in FIG. 2. Alternatively, the processor 91 may implement the functions of the suction pressure acquisition unit 121, the variation coefficient calculation unit 123, the adjustment unit 124, the determination unit 125, the notification unit 126, and the pressure transmission coefficient calculation unit 127, illustrated in FIG. 7.

As described above, the detection device 102 operates as an information processing device that executes various processing methods by reading and executing programs. Alternatively, the detection device 102 may implement the same functions as those of each embodiment described above by reading the programs mentioned above from a recording medium by a medium reader and executing the programs thus read. Note that, the programs mentioned here are not limited to the manner of being executed by the detection device 102. For example, the present invention may be applied as well to a case where another computer or server executes the programs or when these devices work together to execute the programs.

These programs may be distributed via a network, such as the internet. These programs may be recorded in a computer-readable recording medium, such as a hard disk, flexible disc (FD), CD-ROM, magneto-optical disk (MO), or digital versatile disc (DVD), and read from the recording medium and executed by a computer.

Application

Further, the pressure transmission coefficient may also be used for the following processes. For example, the pressure transmission coefficient may also be applied to frequency analysis. When the pressure vibration is not transmitted due to cavities or the like, there is a possibility that the peak of the natural vibration related to an abnormality also becomes lower and unable to exceed the threshold value generally set in abnormality detection, and makes it difficult to detect the abnormality. Even in this case, by adjusting the natural vibration by using the pressure transmission coefficient, it is possible to raise the peak of the natural vibration and thereby detect the abnormality.

For example, the detection device 102 may be provided with an abnormality detection unit that performs abnormality detection by obtaining the vibration of the pump 12 and detecting the peak of the natural vibration by fast Fourier transform (FFT) when a foreign matter is deposited on the impeller of the pump 12. However, even in this case, when the suction pressure is low, the peak of the natural vibration may become difficult to observe. Therefore, by using the pressure transmission coefficient, the abnormality detection unit adjusts the arithmetic operation result using FFT, and thereby makes it possible to obtain the peak of the natural vibration even at low pressure.

Further, the detection device 102 may be provided with an analysis unit that analyzes the vibration of the pipe 11. Here, there is a possibility that the vibration of the pipe 11 is reduced when the suction pressure is remarkably low. Therefore, the analysis unit adjusts the vibration of the pipe 11 by using the pressure transmission coefficient, and thereby improves the detection accuracy of the vibration of the pipe 11.

Figure 10:
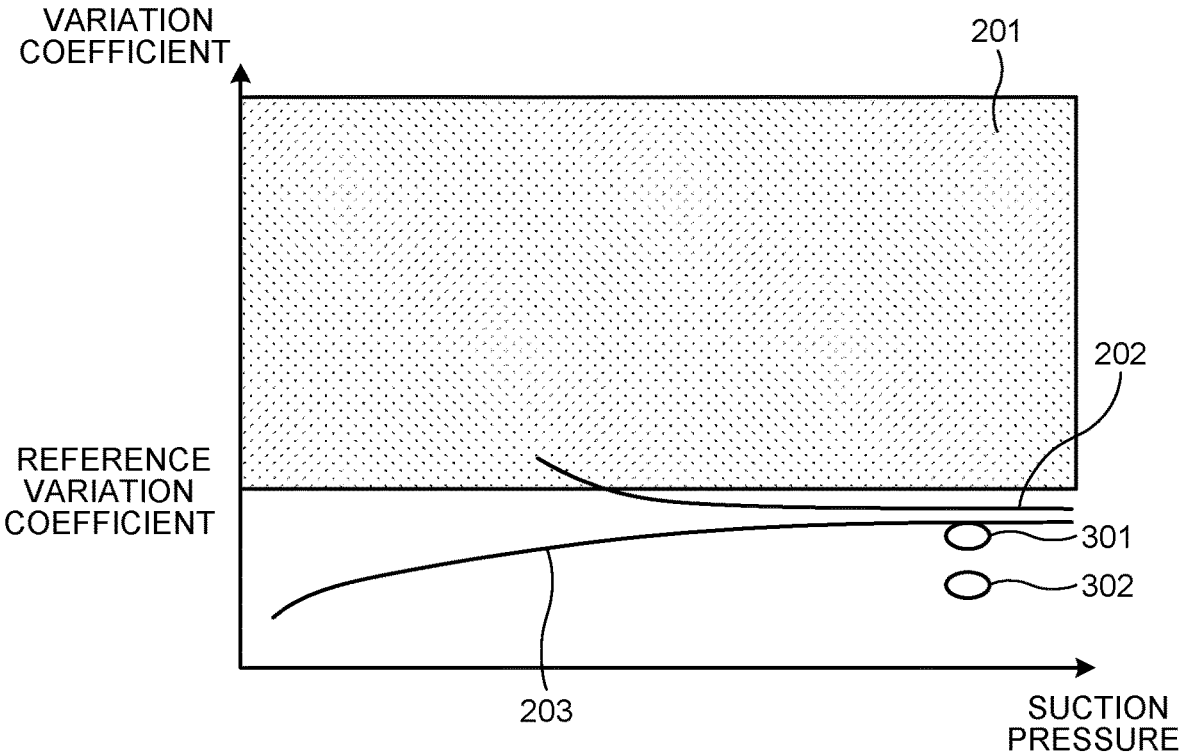
FIG. 10 is a diagram for explaining process abnormality detection using the variation coefficient.

Further, the detection device 102 may use the variation coefficient before adjustment to perform malfunction sign detection for the pump 12 or the like, or process abnormality detection. FIG. 10 is a diagram for explaining process abnormality detection using the variation coefficient. For example, a process using the pump 12 is normally monitored at an area 301 in FIG. 10. When the monitoring condition of this process changes to the condition of an area 302, it can be seen that, since the variation coefficient is lower, the pressure variation amount is smaller than in the normal monitoring state. When the variation coefficient is small, this is a state where the impeller of the pump 12 is shaved, that is, a state where the edge of the impeller for driving out the fluid is shaved and the pressure variation is smaller than normal, so it is becoming more difficult for the pump 12 to send out the fluid.

Therefore, the detection device 102 may include a pump abnormality detection unit that performs abnormality detection of a process using the pump 12 in accordance with the variation coefficient. The pump abnormality detection unit acquires a variation coefficient from the variation coefficient calculation unit 123. Then, the pump abnormality detection unit determines that the replacement time of the impeller of the pump 12 is approaching, when the variation coefficient is smaller than a threshold value determined in advance. Alternatively, the pump abnormality detection section may determine that the replacement time of the impeller of the pump 12 is approaching, when the variation coefficient difference from the normal monitoring state is greater than a threshold value determined in advance.

Further, by recording the relationship between the variation coefficient and each member of the pump 12 at the timing of replacement and maintenance, it becomes possible to more rigorously evaluate the relationship between the pressure and the variation coefficient, and to estimate future replacement timing more accurately without an overhaul of equipment. This eliminates the need for overhaul costs, which can amount to several million yen per unit of the pump 12, for example. These are application examples related to degradation diagnosis for equipment in the medium to long term (several years).

Further, as an application example in the short term, there is process abnormality detection. Specifically, when the variation coefficient changes in the short term under the same pressure, there is a possibility that the viscosity related to the suction pressure variation is changing. Thus, it can be expected to estimate a process abnormality from the viscosity estimation. That is, the detection device 102 may be provided with a process abnormality detection unit that detects an abrupt change in variation coefficient under the same suction pressure, and estimates the occurrence of viscosity change to determine a process abnormality. For example, when the value obtained by dividing the difference in variation coefficient under the same suction pressure by the time of this period exceeds the upper limit threshold value or falls below the lower limit threshold value, the process abnormality detection unit can determine that the variation coefficient has changed abruptly.

Further, the detection device 102 may store information related to each pump 12, such as trend information of cavitation occurrence cumulative time obtained by cavitation detection. The administrator may refer to the trend information of cavitation occurrence cumulative time possessed by the detection device 102, and grasp the cavitation occurrence tendency, to identify a pump 12 that needs an overhaul and to plan the maintenance timing.

Figure 11:
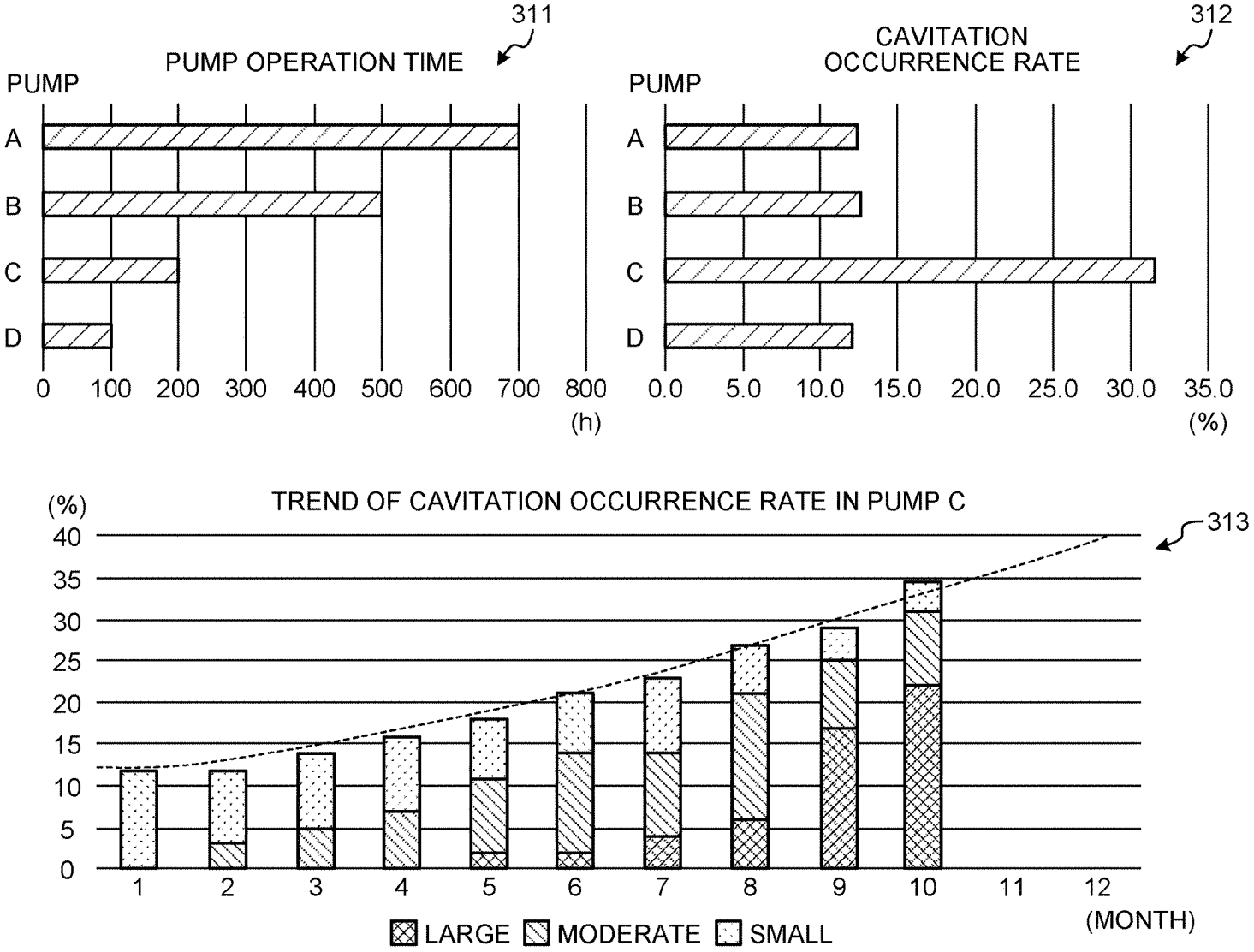
FIG. 11 is a diagram illustrating an example of statistical information related to cavitation.

FIG. 11 is a diagram illustrating an example of statistical information related to cavitation. Here, an explanation will be given of a case where there are pumps A to D. A graph 311 illustrates pump operation time for one month. In the graph 311, the vertical axis represents the pump type, and the horizontal axis represents the operation time. A graph 312 illustrates the cavitation occurrence rate for one month. In the graph 312, the vertical axis represents the pump type, and the horizontal axis represents the cavitation occurrence rate. A graph 313 illustrates the trend of cavitation occurrence in the pump C. In the graph 313, the horizontal axis represents each month, and the vertical axis represents the cavitation occurrence rate. For example, the detection device 102 may store these graphs 311 to 313.

By referring to the graph 311 stored in the detection device 102, the administrator can see that the operation time is longer in the order of the pumps A, B, C, and D. Generally, maintenance is performed in accordance with the cumulative operation time of each pump 12, and thus the administrator can judge that the priority of maintenance is higher in the order from pump A.

Further, by referring to the graph 312 stored in the detection device 102, the administrator can confirm the cavitation occurrence rate, and confirm that the cavitation occurrence rate at the pump C is higher than those at the other pumps A, B, and D.

Further, focusing on the pump C, the administrator can see by referring to the graph 313 that the cavitation occurrence rate of the pump C tends to increase. From this tendency, the administrator can predict that the cavitation occurrence rate of the pump C will increase also in the succeeding month. In addition, the administrator can presume that, since large cavitation occurred in the most recent month, the damage of the pump C has been further progressing. By adding the cavitation occurrence rate to the normal maintenance indication obtained from the pump operation cumulative time, the administrator can estimate and prioritize the maintenance timing of the pumps more accurately.

A few exemplary combinations of the technological features disclosed herein are given below.

(1) A detection device includes:

- a pressure acquisition unit that acquires pressure data indicating pressure of a pump;
- a variation coefficient calculation unit that calculates a variation coefficient indicating amplitude of pressure magnitude of the pump based on the pressure data acquired by the pressure acquisition unit;
- an adjustment unit that performs adjustment detection information which includes the variation coefficient calculated by the variation coefficient calculation unit, by using a pressure transmission coefficient representing ease of transmission for pressure of the pump, the detection information being used for cavitation occurrence detection; and a determination unit that detects cavitation occurrence in the pump based on the detection information adjusted by the adjustment unit.

(2) The detection device according to (1), wherein the pressure acquisition unit acquires, as pressure of the pump, any one of pump suction pressure, priming water pressure, drain pressure, and discharge pressure.

(3) The detection device according to (1) or (2), wherein the adjustment unit adjusts the variation coefficient by using the pressure transmission coefficient, and thereby calculates an adjusted variation coefficient.

(4) The detection device according to any one of (1) to (3), wherein the determination unit determines that cavitation has occurred in the pump, when the adjusted variation coefficient exceeds a reference variation coefficient determined in advance and included in the detection information.

(5) The detection device according to any one of (1) to (4), wherein the adjustment unit adjusts a reference variation coefficient, which is a threshold value to be used for the cavitation occurrence detection, determined in advance and included in the detection information, and thereby calculates an adjusted reference variation coefficient, and the determination unit determines that cavitation has occurred in the pump, when the variation coefficient exceeds the adjusted reference variation coefficient.

(6) The detection device according to any one of (1) to (5), further including a pressure transmission coefficient calculation unit that calculates the pressure transmission coefficient.

(7) The detection device according to (6), wherein the pressure transmission coefficient calculation unit calculates the pressure transmission coefficient based on pressure of the pump and a state of the cavitation occurrence.

(8) The detection device according to (6), The detection device according to claim 6, wherein the pressure transmission coefficient calculation unit calculates the pressure transmission coefficient, by using a relationship between a dynamic pressure obtained from a flow rate of the pump and a static pressure obtained from pressure of the pump, based on the flow rate.

(9) The detection device according to (8), The detection device according to claim 8, wherein the variation coefficient calculation unit calculates the variation coefficient based on the flow rate, by using a relationship between a dynamic pressure obtained from a flow rate of the pump and a static pressure obtained from pressure of the pump.

(10) The detection device according to (6), wherein the pressure transmission coefficient calculation unit calculates the pressure transmission coefficient based on a relationship between a time from an operate start of the pump to an operate stop and pressure of the pump.

(11) The detection device according to (6), wherein the pressure transmission coefficient calculation unit calculates the pressure transmission coefficient based on basic information of a fluid sent by the pump.

(12) The detection device according to (6), wherein the pressure transmission coefficient calculation unit calculates the pressure transmission coefficient based on information of measurement pressure measured by a second pressure gauge disposed farther from the pump than a first pressure gauge that measures pressure of the pump.

(13) A detection method of causing a detection device to:

acquire pressure data indicating pressure of a pump;

calculate a variation coefficient indicating amplitude of pressure magnitude of the pump based on the pressure data acquired;

perform adjustment detection information which includes the variation coefficient calculated by using a pressure transmission coefficient representing ease of transmission for pressure of the pump, the detection information being used for cavitation occurrence detection; and detect cavitation occurrence in the pump based on the detection information adjusted.

(14) A detection system including a pressure measurement device and a detection device, wherein the pressure measurement device measures pressure of a pump, and generates pressure data indicating a measurement result, and the detection device includes a pressure acquisition unit that acquires the pressure data from the pressure measurement device, a variation coefficient calculation unit that calculates a variation coefficient indicating amplitude of pressure magnitude of the pump based on the pressure data acquired by the pressure acquisition unit, an adjustment unit that performs adjustment detection information that includes the variation coefficient calculated by the variation coefficient calculation unit, by using a pressure transmission coefficient representing ease of transmission for pressure of the pump, the detection information being used for cavitation occurrence detection, and a determination unit that detects cavitation occurrence in the pump based on the detection information adjusted by the adjustment unit.

In one aspect, the present invention makes it possible to improve the accuracy of cavitation occurrence detection.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A detection device for detecting cavitation occurrence in a pump external to the detection device, the detection device comprising a processor configured to:

acquire pressure data indicating pressure of the pump;

calculate a variation coefficient indicating amplitude of pressure magnitude of the pump based on the acquired pressure data;

perform adjustment of detection information which includes the calculated variation coefficient, by using a pressure transmission coefficient representing ease of transmission for pressure of the pump, the detection information being used for cavitation occurrence detection; and detect cavitation occurrence in the pump based on the adjusted detection information, wherein the processor is further configured to:

adjust a reference variation coefficient, which is a threshold value to be used for the cavitation occurrence detection, determined in advance and included in the detection information, and thereby calculates an adjusted reference variation coefficient; and determine that cavitation has occurred in the pump, when the variation coefficient exceeds the adjusted reference variation coefficient.

2. The detection device according to claim 1, wherein the processor is further configured to acquire, as pressure of the pump, any one of pump suction pressure, priming water pressure, drain pressure, and discharge pressure.

3. The detection device according to claim 1, wherein the processor is further configured to adjust the variation coefficient by using the pressure transmission coefficient, and thereby calculates an adjusted variation coefficient.

4. The detection device according to claim 3, wherein the processor is further configured to determine that cavitation has occurred in the pump, when the adjusted variation coefficient exceeds a reference variation coefficient determined in advance and included in the detection information.

5. The detection device according to claim 1, the processor is further configured to calculate the pressure transmission coefficient.

6. The detection device according to claim 5, wherein the processor is further configured to calculate the pressure transmission coefficient based on pressure of the pump and a state of the cavitation occurrence.

7. The detection device according to claim 5, wherein the processor is further configured to calculate the pressure transmission coefficient, by using a relationship between a dynamic pressure obtained from a flow rate of the pump and a static pressure obtained from pressure of the pump, based on the flow rate.

8. The detection device according to claim 7, wherein the processor is further configured to calculate the variation coefficient based on the flow rate, by using a relationship between a dynamic pressure obtained from a flow rate of the pump and a static pressure obtained from pressure of the pump.

9. The detection device according to claim 5, wherein the processor is further configured to calculate the pressure transmission coefficient based on a relationship between a time from an operate start of the pump to an operate stop and pressure of the pump.

10. The detection device according to claim 5, wherein the processor is further configured to calculate the pressure transmission coefficient based on basic information of a fluid sent by the pump.

11. The detection device according to claim 5, wherein the processor is further configured to calculate the pressure transmission coefficient based on information of measurement pressure measured by a second pressure gauge disposed farther from the pump than a first pressure gauge that measures pressure of the pump.

12. A detection method of causing a detection device to:

acquire pressure data indicating pressure of a pump;

calculate a variation coefficient indicating amplitude of pressure magnitude of the pump based on the pressure data acquired;

perform adjustment of detection information which includes the variation coefficient calculated by using a pressure transmission coefficient representing ease of transmission for pressure of the pump, the detection information being used for cavitation occurrence detection; and detect cavitation occurrence in the pump based on the detection information adjusted, wherein the method further causes the detection device to:

adjust a reference variation coefficient, which is a threshold value to be used for the cavitation occurrence detection, determined in advance and included in the detection information, and thereby calculates an adjusted reference variation coefficient; and determine that cavitation has occurred in the pump, when the variation coefficient exceeds the adjusted reference variation coefficient.

13. A detection system comprising a pressure measurement device and a detection device for detecting cavitation occurrence in a pump external to the detection device, wherein the pressure measurement device measures pressure of the pump, and generates pressure data indicating a measurement result, and the detection device includes a processor configured to:

acquire the pressure data from the pressure measurement device;

calculate a variation coefficient indicating amplitude of pressure magnitude of the pump based on the acquired pressure data;

perform adjustment of detection information that includes the calculated variation coefficient, by using a pressure transmission coefficient representing ease of transmission for pressure of the pump, the detection information being used for cavitation occurrence detection; and detect cavitation occurrence in the pump based on the adjusted detection information, wherein the processor is further configured to:

adjust a reference variation coefficient, which is a threshold value to be used for the cavitation occurrence detection, determined in advance and included in the detection information, and thereby calculates an adjusted reference variation coefficient; and determine that cavitation has occurred in the pump, when the variation coefficient exceeds the adjusted reference variation coefficient.

14. A detection device for detecting cavitation occurrence in a pump external to the detection device, the detection device comprising a processor configured to:

acquire pressure data indicating pressure of the pump;

calculate a variation coefficient indicating amplitude of pressure magnitude of the pump based on the acquired pressure data by using a standard deviation and an average value of the pressure data for a detection target period, the variation coefficient being an index that indicates how much amplitude a fluctuation of the pressure has;

perform adjustment of detection information which includes the calculated variation coefficient, by using a pressure transmission coefficient representing ease of transmission for pressure of the pump in a case of cavitation occurrence, the detection information being used for cavitation occurrence detection; and detect cavitation occurrence in the pump based on the adjusted detection information, wherein the processor is further configured to:

adjust the variation coefficient by multiplication with the pressure transmission coefficient, and thereby to calculate an adjusted variation coefficient; and determine that cavitation has occurred in the pump, when the adjusted variation coefficient exceeds a reference variation coefficient determined in advance and included in the detection information.

15. A detection method of causing a detection device to:

acquire pressure data indicating pressure of a pump;

calculate a variation coefficient indicating amplitude of pressure magnitude of the pump based on the acquired pressure data by using a standard deviation and an average value of the pressure data for a detection target period, the variation coefficient being an index that indicates how much amplitude a fluctuation of the pressure has;

perform adjustment of detection information which includes the variation coefficient calculated by using a pressure transmission coefficient representing ease of transmission for pressure of the pump in a case of cavitation occurrence, the detection information being used for cavitation occurrence detection; and detect cavitation occurrence in the pump based on the detection information adjusted, wherein the method further causes the detection device to:

adjust the variation coefficient by multiplication with the pressure transmission coefficient, and thereby to calculate an adjusted variation coefficient; and determine that cavitation has occurred in the pump, when the adjusted variation coefficient exceeds a reference variation coefficient determined in advance and included in the detection information.

16. A detection system comprising a pressure measurement device and a detection device for detecting cavitation occurrence in a pump external to the detection device, wherein the pressure measurement device measures pressure of the pump, and generates pressure data indicating a measurement result, and the detection device includes a processor configured to:

acquire the pressure data from the pressure measurement device;

calculate a variation coefficient indicating amplitude of pressure magnitude of the pump based on the acquired pressure data by using a standard deviation and an average value of the pressure data for a detection target period, the variation coefficient being an index that indicates how much amplitude a fluctuation of the pressure has;

perform adjustment of detection information that includes the calculated variation coefficient, by using a pressure transmission coefficient representing ease of transmission for pressure of the pump in a case of cavitation occurrence, the detection information being used for cavitation occurrence detection; and detect cavitation occurrence in the pump based on the adjusted detection information, wherein the processor is further configured to:

adjust the variation coefficient by multiplication with the pressure transmission coefficient, and thereby to calculate an adjusted variation coefficient; and determine that cavitation has occurred in the pump, when the adjusted variation coefficient exceeds a reference variation coefficient determined in advance and included in the detection information.

* * * * *